United States Patent [19]

Furuichi et al.

[11] 4,449,812

[45] May 22, 1984

[54] PAPER LEAF HANDLING APPARATUS

[75] Inventors: Katsushi Furuichi; Naomi Takahata, both of Yokohama, Japan

[73] Assignee: Canon Kabushiki Kaisha, Tokyo, Japan

[21] Appl. No.: 311,448

[22] Filed: Oct. 14, 1981

[30] Foreign Application Priority Data

| | | | |
|---|---|---|---|
| Oct. 17, 1980 | [JP] | Japan | 55-145272 |
| Oct. 17, 1980 | [JP] | Japan | 55-145276 |
| Oct. 17, 1980 | [JP] | Japan | 55-145294 |
| Oct. 17, 1980 | [JP] | Japan | 55-145298 |
| Dec. 18, 1980 | [JP] | Japan | 55-180199 |

[51] Int. Cl.[3] ..... G03G 15/00

[52] U.S. Cl. ..... 355/14 SH; 355/3 SH; 271/294

[58] Field of Search ..... 355/14 SH, 3 SH, 14 R; 271/294

[56] References Cited

U.S. PATENT DOCUMENTS

| | | | |
|---|---|---|---|
| 3,866,904 | 2/1975 | Stemmle | 271/294 X |
| 3,995,748 | 12/1976 | Looney | 271/294 X |
| 4,145,037 | 3/1979 | Mol | 271/294 X |
| 4,170,414 | 10/1979 | Hubert et al. | 355/14 SH |
| 4,281,919 | 8/1981 | Nomura et al. | 355/14 SH |
| 4,358,197 | 11/1982 | Kukucka et al. | 355/14 SH |

*Primary Examiner*—Richard L. Moses

*Attorney, Agent, or Firm*—Fitzpatrick, Cella, Harper & Scinto

[57] ABSTRACT

A paper leaf handling apparatus has a receiving unit for receiving paper leaves, distributor for distributing to the receiving unit the paper leaves having images formed thereon and conveyed from an image formation apparatus to the paper leaf handling apparatus, detector for detecting the connected condition of the paper leaf handling apparatus and the image formation apparatus, and warner for warning of any improper connection detected by the detector.

21 Claims, 25 Drawing Figures

| FIG. 10A |
| --- |
| FIG. 10B |

| FIG. 17A |
| --- |
| FIG. 17B |

PAPER LEAF HANDLING APPARATUS

BACKGROUND OF THE INVENTION

1. Field of the Invention

This invention relates to an apparatus which is added to an image formation apparatus such as a copying apparatus, a printer or a recording machine and which handles paper leaves such as originals, copy paper or recording paper.

2. Description of the Prior Art

As a part of a copying apparatus, a sorter has heretofore been integrally attached to the copying apparatus to distribute and receive paper leaves such as copy paper having images formed thereon (hereinafter referred to as sheets), but along with the growing tendency toward automatization and manpower saving, it is now also used with a small apparatus or a popular apparatus. Also, a copying apparatus now has optional components and thus it has come to be separated into a copying apparatus body and a sorter. Thus, various members for the connection of the copying apparatus and the sorter have been devised and various contrivances have been made so that their operability may not be marred. However, none of the various methods heretofore devised enables the operator to know whether the copying apparatus and the sorter have been properly connected together, and it has often been the case that the operator commits errors or the copying apparatus fails to run and thereby makes the operator disoriented.

Generally, a sorter has a sheet receiving bed (a tray group) comprising ten to twenty or more stages and sheets continuously carried out from an apparatus such as a copying apparatus at predetermined intervals are successively conveyed and received into a predetermined tray by belt conveyor means, a plurality of roller means or conveyor means comprising a combination of these.

Among sorters, there is one in which the trays disposed at the carry-out port of an apparatus such as a copying apparatus are successively moved when distribution and reception of sheets are effected.

In such a sorter, the tray group is maintained stationary at a certain position by fall preventing means such as a pawl. Accordingly, when the tray group is to be moved downwardly from a certain position, the tray group must be once moved upwardly and the pawl must be released, whereafter the tray group must be moved downwardly. This has heretofore been accomplished by changing over a motor to move the tray group upwardly for a predetermined timer time and move it downwardly after the timer time. However, the amount of movement of the tray group within the timer time is irregular over a wide range due to the influences of the quantity of sheets in the tray group, the irregularity of the speed of the motor, the mechanical back-lash of the tray group moving mechanism, etc. Therefore, such a situation that the motor is changed over in spite of the pawl having not completely been released may occur and, when such a situation occurs, damage of the pawl, damage of the power transmitting mechanism from the motor shaft, etc., occur and this is very dangerous.

In such a sorter, the tray group is moved upwardly or downwardly even when copying on only one sheet is effected, and if the copying apparatus and the sorter are controlled in a dialog form, there occurs a waste of time and a repeated upward and downward movement of the tray group which leads to a disadvantage in mechanical durability.

Also, where such a sorter is connected and used with a copying apparatus which permits interruption copying, if interruption copying is carried out during sorting, the tray into which the sheet for the interruption copying has been received cannot be identified. Thus, there occurs an inconvenience that interruption copying cannot be carried out during sorting.

Also, in such a sorter, as a method of detecting the position of each tray, three microswitches, for example, have been used to detect the uppermost position, the lowermost position and the intermediate position, respectively. Such method, however, requires three detecting members which means a higher cost. Also, the entrance of each tray must generally be designed with strict dimensions inasmuch as a number of sheets must be piled on each tray, and it is necessary to stop the tray group with high accuracy so that sheets may be accurately carried into each tray through the entrance. In the case of microswitches, this accuracy all depends on the operating point of the microswitches. As is well known, however, the operating point of microswitches is greatly irregular and has a hysteresis characteristic and moreover, microswitches are poor in durability and are very unsuitable for an apparatus which requires reciprocal movement. Where three photointerrupters are employed in place of microswitches, it is necessary to provide three tray position indicating members opposed to these photointerrupters, and this leads to a very complicated construction as well as a disadvantage in terms of the space required.

Also, in a copying apparatus or the like, together with a sorter, an automatic sheet original feeding device is sometimes used to feed sheet originals one by one to the original supporting surface of the copying apparatus. Such automatic sheet original feeding device is grouped into two types, namely, the type in which a number of sheet originals are placed on a feeding tray at a time and fed therefrom one by one and the type in which sheet originals are placed one by one on the feeding tray and fed therefrom.

In the device of the latter type, the handling of the original is effected by the copy start button of the copying apparatus or an original insertion button provided on the automatic original feeding device, after the original has been inserted. In any case, however, the start button must be depressed after the original has been inserted. That is, the procedures of inserting each original and depressing the button after each original has been inserted are required and this is very cumbersome.

SUMMARY OF THE INVENTION

It is an object of the present invention to eliminate the above-noted disadvantages and to provide a paper leaf handling apparatus which is simple in construction and reliable in operation.

It is also an object of the present invention to provide a paper leaf handling apparatus which distributes and receives paper leaves having images formed thereon by an image formation apparatus and which has means for detecting the connected condition of the image formation apparatus and the paper leaf handling apparatus and warning means operable by the detector means to warn of any improper connection detected by the detector means.

It is another object of the present invention to provide a paper half handling apparatus in which a paper leaf receiving unit having a plurality of trays is moved to cause the trays to successively correspond to a paper leaf carry-out port to thereby effect distribution of paper leaves, characterized in that provision is made of means for preventing the falling of the trays, means for releasing the fall preventing means, and means for detecting that the fall preventing means has been released by the releasing means and that when the receiving unit is to be moved downwardly, the detector means detects that the fall preventing means has been released by the releasing means, whereby starting the downward movement of the receiving unit.

It is still another object of the present invention to provide a paper leaf handling apparatus in which a paper leaf receiving unit having a plurality of trays is moved to cause the trays to successively correspond to the paper leaf carry-out port of an image formation apparatus thereby effecting distribution of paper leaves, characterized in that a particular tray is selected from among the plurality of trays by a particular signal from the image formation apparatus and paper leaves carried out from the image formation apparatus during the period said signal is received into said particular tray.

It is yet still another object of the present invention to provide a paper leaf handling apparatus in which a paper leaf receiving unit having a plurality of trays is moved to cause the trays to correspond successively to a paper leaf conveyance path thereby effecting reception or feeding of paper leaves, characterized in that two different tray position display portions formed on a moving member movable with the paper leaf receiving unit are detected by two position detecting members and the operation of the paper leaf receiving unit is controlled by a combination of the output signals of the position detecting members.

It is another object of the present invention to provide a paper leaf handling apparatus which has been improved so as to be automatically started by inserting an original without depressing a button in order to eliminate the cumbersomeness of two operations for an original involved in the prior art and which eliminates any improper feeding of originals such as oblique feeding resulting from the automatic starting.

The above and other objects will become fully apparent from the following detailed description of the invention taken in conjunction with the accompanying drawings.

BRIEF DESCRIPTION OF THE DRAWINGS

FIGS. 7-1 and 7-2 show the detecting mechanism of a position detecting sensor.

DESCRIPTION OF THE PREFERRED EMBODIMENTS

Figure 1:
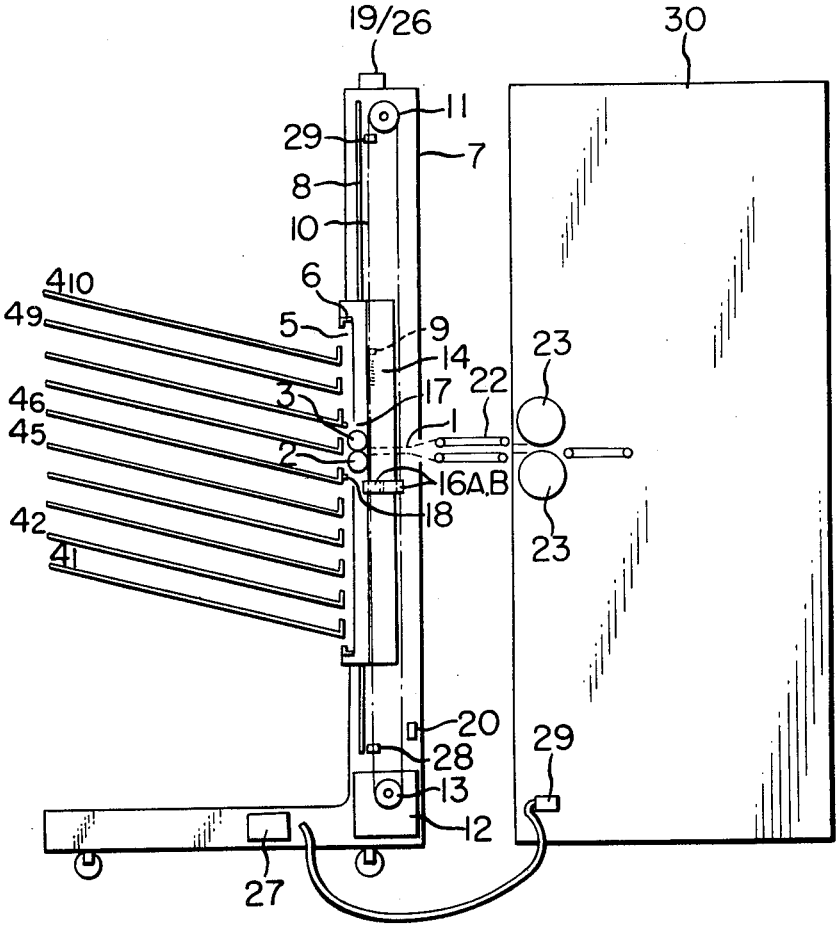
FIG. 1 is a cross-sectional view of a sorter to which the present invention is applied.

FIG. 1 is a cross-sectional view of a sorter to which the present invention is applied. In FIG. 1, sheets to be distributed are conveyed out of a copying apparatus 30 after image formation, and have the images thereon fixed by fixing rollers 23, whereafter they are introduced into the conveyance guide 1 of the sorter by a belt 22. They are then discharged, for example, into a tray 4-6 by carry-in means comprising two movable rollers 2 and 3. Trays 4-1, 4-2, . . . , 4-5, 4-6, . . . , 4-9, 4-10 are secured to a tray frame 5 which in turn is secured to a lift member 6. The lift member 6 is vertically movable along a guide groove 8 by at least a distance corresponding to the distance from the tray 4-1 to the tray 4-10. A chain (or a wire or the like) 10 is secured to the upper end of a chain receiving member 9 which in turn is secured to the lift member 6, and the chain 10 is deflected by an upper idler 11 and passes to a sprocket 13 on the shaft end of a lower motor 12, the other end of the chain 10 being secured to the lower end of the chain receiving member 9 through a spring 14. This spring is for absorbing any variation in length of the chain 10 and any shock. Thus, if the motor 12 is rotatively driven in clockwise direction, the trays 4-1, 4-2, . . . will be moved up together. Further, the lift member 6 is provided with cut-away grooves 15 at intervals equal to the intervals between the trays, and when position detecting sensors 16A and B secured to a strut 7 has detected any cut-away groove 15, the sheet receiving port of a tray corresponding to that cut-away groove 15 becomes coincident with the position of the nip between the movable rollers 2 and 3. Sheet detecting sensors 17 and 18 are disposed on the opposite sides of a sheet conveyance path between the nip between the movable rollers 2 and 3 and the trays, and can detect that a sheet has been received into one of the trays.

Figure 2:
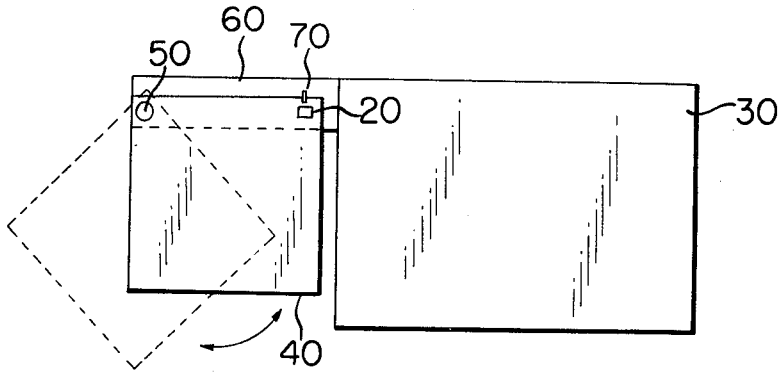
FIG. 2 is a plan view showing the positional relation between a copying apparatus and the sorter.

FIG. 2 is a plan view showing the positional relation between the copying apparatus and the sorter. Reference numeral 30 designates the copying apparatus, reference numeral 40 denotes the sorter, reference numeral 50 designates the rotary shaft of the sorter 40, reference numeral 60 denotes a holding member for the rotary shaft 50, and reference numeral 70 designates a cam for closing a microswitch 20 to be described, the cam 70 being installed on the rotary shaft holding member 60. The sorter 40 is pivotable about the rotary shaft 50 and, when the sorter and the copying apparatus are connected together, the microswitch 20 is closed by the cam 70.

Operation of the sorter will now be described. When the sorter is connected to the copying apparatus, the microswitch 20 is closed. When a sorter select switch 19 is depressed, an interior lamp 26 is turned on. First, by the revolution of the motor 12, the trays 4-1, . . . , 4-10 are moved up to their uppermost position and, when the position detecting sensor 16 detects that the sheet receiving port of the tray 4-1 has come to a position corresponding to the nip between the movable rollers 2 and 3, the motor 12 is stopped and electromagnetic brake is applied. Subsequently, a sheet on which an image has been formed is conveyed into the tray 4-1 by the movable rollers 2 and 3. The movable rollers 2 and 3 are rotatable by a motor 27 which is operated by the copy start signal of the copying apparatus body. When the trailing end of the sheet is detected by the sheet detecting sensors 17 and 18, the motor 12 is revolved in counter-clockwise direction and, when it is detected that the sheet receiving port of the tray 4-2 has come to a position corresponding to the nip between the movable rollers 2 and 3, namely, when the cut-away groove 15 corresponding to the tray 4-2 is detected by the position sensors 16A and B, the motor 12 is stopped and brake is applied. Thus, the tray 4-2 becomes ready to receive the sheet.

Thereafter, the above-described operation is repeated a required number of times, whereafter the initial condition is restored by a return signal.

Control may also be effected such that the trays are once moved down to their lowermost position and sheets are received into the tray 4-10.

Figure 3:
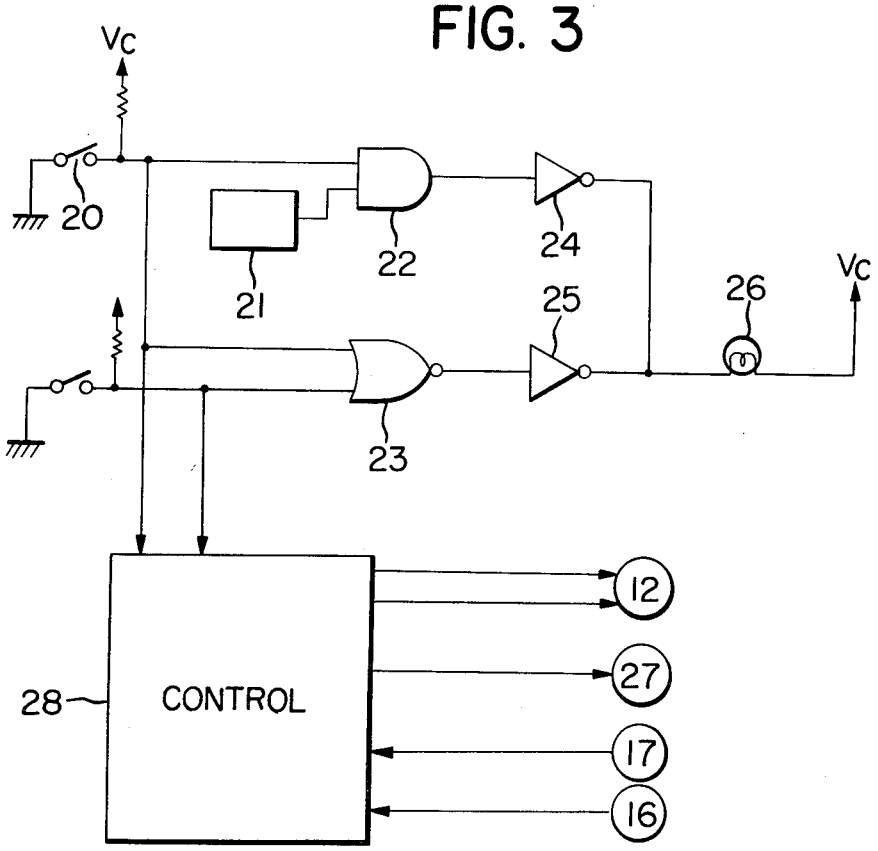
FIG. 3 is a diagram showing an example of the control circuit of the sorter.

FIG. 3 shows an example of the control circuit for the above-described sorter. Reference numeral 19 designates the aforementioned sorter select switch which is an illumination type push button switch having an interior lamp 26, reference numeral denotes a switch for detecting that the sorter is normally connected to the copying apparatus body, and reference numeral 28 designates a control unit including a microcomputer, gates, driver, etc. The control unit 28 carries out the operation control of the above-described sorter. The microcomputer may be, for example, μCOM43 produced by Nippon Denki Co., Ltd.

When the push button switch 19 is depressed and its contact is closed, one input terminal of a NOR gate 23 becomes "L". This signal is also applied as input to the control unit 28 and operates the motors 12 and 27 as previously described so as to start the operation of the sorter. Also, if the copying apparatus body and the sorter are properly connected together at this time, the switch 20 becomes closed and "L" is applied to one input terminal of an AND gate 22 and of the NOR gate 23. Accordingly, the output of the NOR gate 23 becomes "H" and the lamp 26 is turned on by a driver 25 to display that the machine is operating in the sorter mode. The output signal from an oscillator 21 is applied as input to the other input terminal of the AND gate 22. This oscillator repeats ON-OFF every second, for example, and oscillates constantly. Since the switch 20 is in its closed position, "L" is put out at the output of the AND gate 22 and a driver 24 is not driven. Accordingly, the lamp 26 remains turned on.

If the copying apparatus body and the sorter are not properly connected together, the switch 20 becomes open and "H" is applied as input to the AND gate 22 and the NOR gate 23. Thereby, the output of the NOR gate 23 changes to "L" and no longer drives the driver 25 and the lamp 26 is turned off. "H" is also applied as input to the AND gate 22 and therefore, the AND gate 22 puts out the same signal as the output of the oscillator 21. By this, the driver 24 is driven to cause the lamp 26 to be turned on and off with the same timing as the oscillator. In this manner, the lamp 26 is turned on and off to alert to the operation if the sorter is not properly connected to the copying apparatus body.

The signal indicating that the switch 20 is open is also applied as input to the control unit 28 to effect the necessary control such as stopping the motor 12.

In the above-described embodiment, the interior lamp 26 in the sorter mode switch 19 has been employed as the warning display lamp, but a warning display lamp may be provided separately. As a further alternative, design may be made such that warning is given in the form of sound by causing an electronic buzzer or the like to sound or flicker for a predetermined time.

Also, if control is effected such that when improper connection between the sorter and the copying apparatus body has been detected, the detection signal is supplied as an abnormality signal also to the copying apparatus body to interrupt paper feeding, then waste of sheets may be eliminated.

Further, a design for detecting the degree of the horizontal can be made by providing a plurality of switches for detecting the connected condition of the sorter, whereby any unsatisfactory connection due to an inclination can be detected to ensure proper connection between the sorter and the copying apparatus.

Description will now be made of means for preventing the trays from falling.

Figure 4:
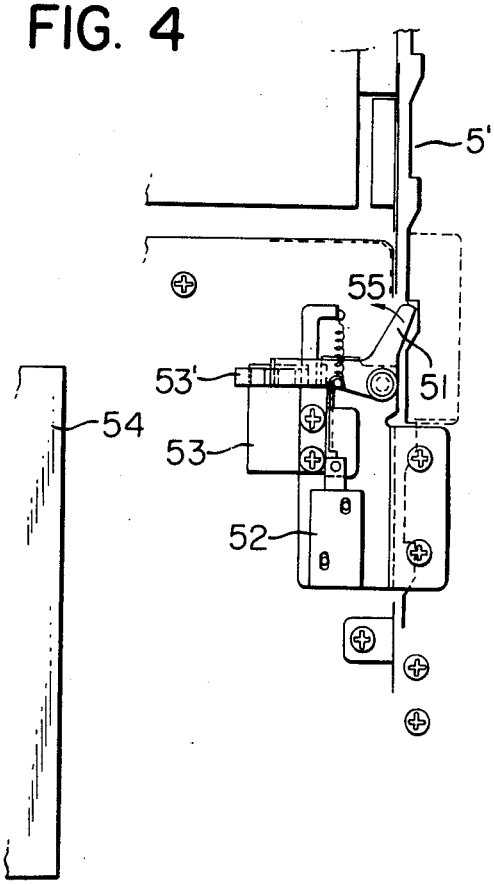
FIG. 4 shows a releasing mechanism for falling preventing means and a release detecting mechanism.

FIG. 4 shows a pawl as the fall preventing means and its releasing mechanism. Reference numeral 5' designates a cam member for receiving a pawl 51 made integral with the tray frame 5, reference numeral 52 denotes a plunger for releasing the pawl, reference numerals 53 and 53' respectively designate a printed plate having incorporated therein a control circuit element for detecting the release of the pawl and a photointerrupter sensor, and reference numeral 54 denotes a printed plate having incorporated therein a control circuit element for controlling the present device.

Figure 5:
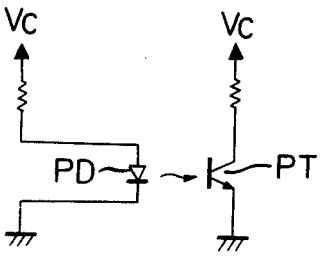
FIG. 5 is a circuit diagram of a photointerrupter.

The photointerrupter sensor 53' is of such a construction as shown in FIG. 5 and, when the plunger 52 is operated, the pawl 51 is released from the cam member and the pawl 51 is rotated in the direction indicated by arrow in FIG. 4 to intercept the light from a photodiode PD to a phototransistor PT. This variation is applied as input to the control circuit on the printed plate 54.

Figure 6:
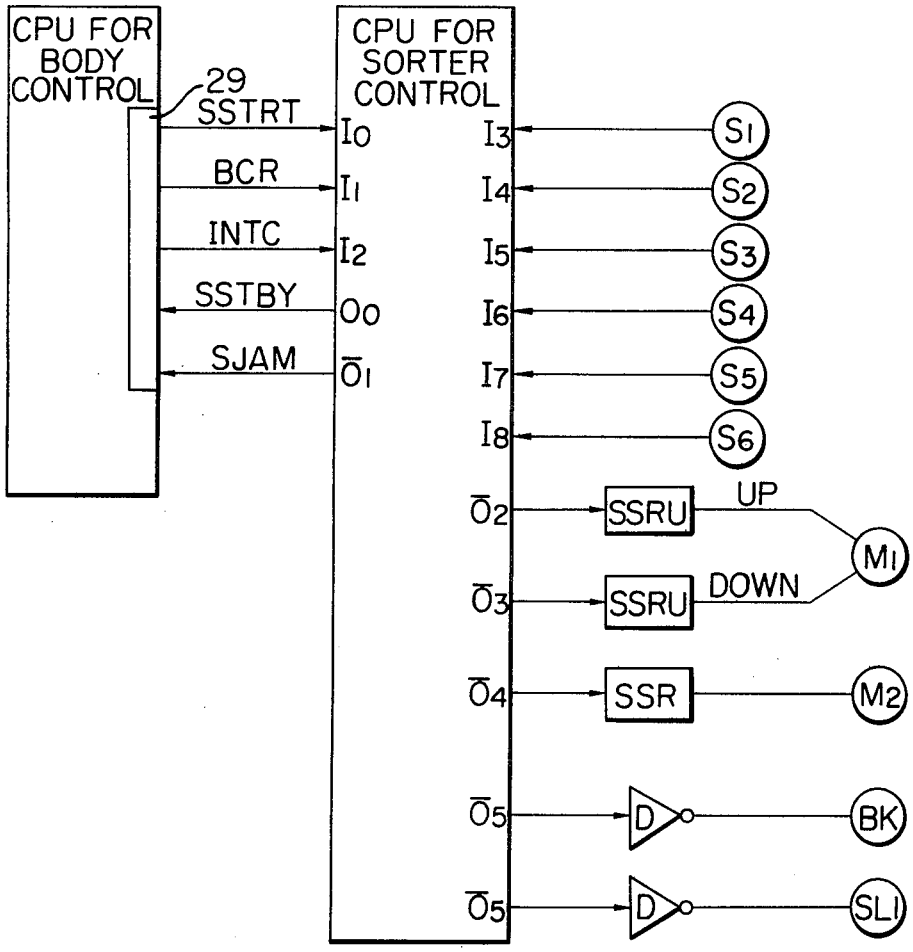
FIG. 6 is a control block diagram.

FIG. 6 shows a control circuit comprising a microcomputer (hereinafter referred to as CPU) on the printed plate 54. This CPU is, for example, 4-bit microcomputer μCOM43 produced by Nippon Denki Co., Ltd. Signals SSTRT, BCR and INTC from the control CPU of the copying apparatus 30 are applied as inputs to the input terminals I0–I2 of the CPU. Signal S1 from the sheet detecting sensor 17, output signals S2 and S3 of the tray position detecting sensors 16A and B, output signal S4 from the pawl release detecting sensor 53' comprising a photointerrupter, output signal S5 from the tray lower end position detecting sensor 19 and output signal S6 from the tray upper end position detecting sensor 20 are applied as inputs to input terminals I3–I8. Sorter stand-by signal SSTBY is put out from an output terminal $O_0$ to the copying apparatus body, and sorter jam signal SJAM is put out from an output terminal 01 to the copying apparatus body. A motor M1 (which corresponds to the motor 12 of FIG. 1) is connected to output terminals 02 and 03 through solid state relays SSRU and SSRD, and a motor M2 for driving the movable rollers 2 and 3 is connected to an output terminal 04 through a solid state relay SSR. An electromagnetic brake BK and a plunger SL1 (which corresponds to the plunger 52 of FIG. 4) are connected to output terminals 05 and 06 through drivers D1 and D2.

Figures 1, 7:
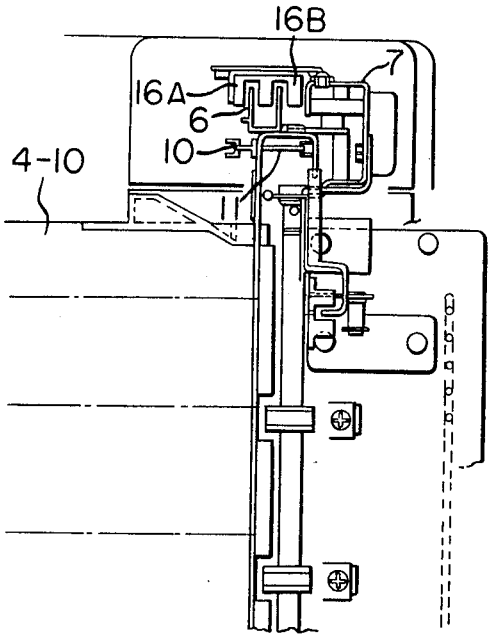
Figures 2, 7:
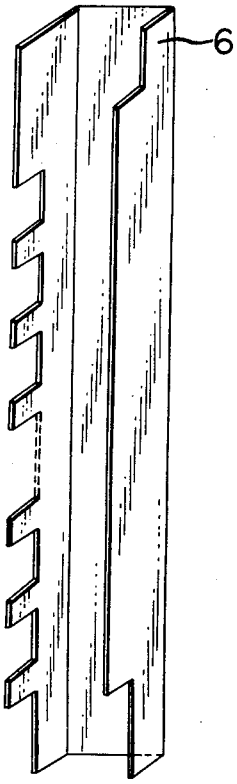

The position detecting sensors 16A and B will now be described by reference to FIG. 7-1. Reference characters 16A and B designate the aforementioned photointerrupter sensors, and reference numeral 6 denotes the aforementioned lift member to which a scale as shown in FIG. 7-2 is attached to detect the position of the trays and which effects the position detection of the trays by a combination of the output signals S2 and S3 of the sensors 16A and 16B. That is, if the two signals S2 and S3 are encoded and are "1" and "0", respectively, the tray group reaches its lowermost position and the lift member detects that the tray 4-10 has been selected and has come to the nip between the movable rollers. If the signals S2 and S3 are "0" and "1", respectively, the lift member detects that the intermediate trays 4-2 - 4-9 have been selected. If both signals S2 and S3 are "1", the tray group reaches its uppermost position and the lift member detects that the tray 4-1 has been selected.

Figure 8A:
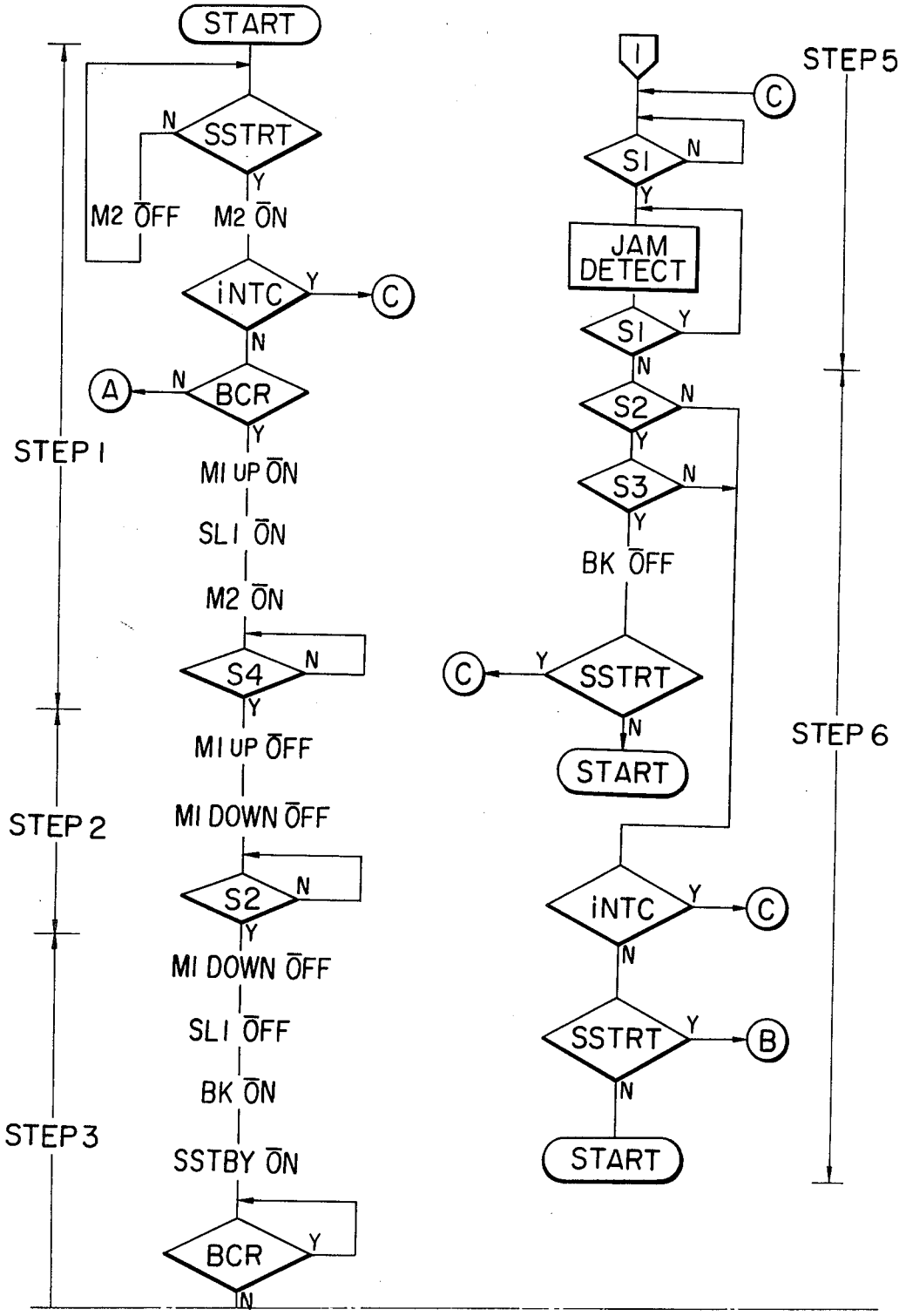
FIGS. 8, 8A, 8B, 10, 10A, 10B and 12 are control flow charts stored in a sorter controlling CPU.
Figure 8B:
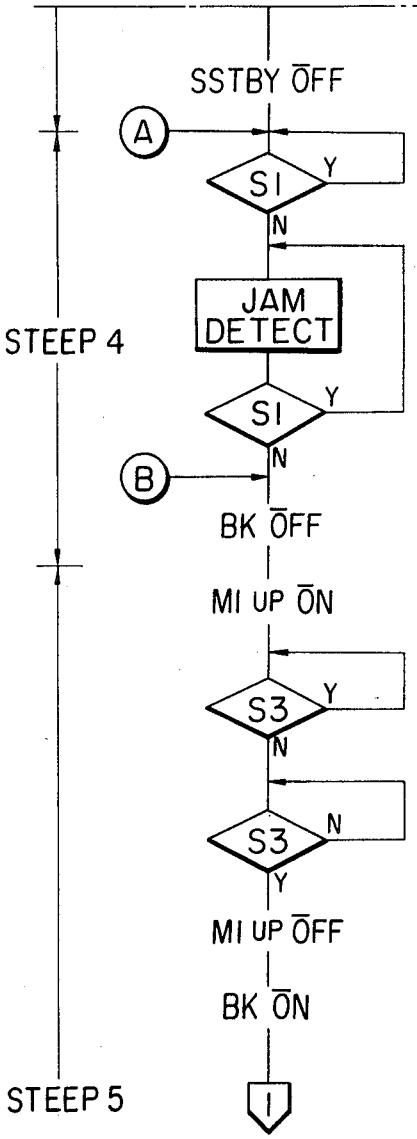
Figure 8:
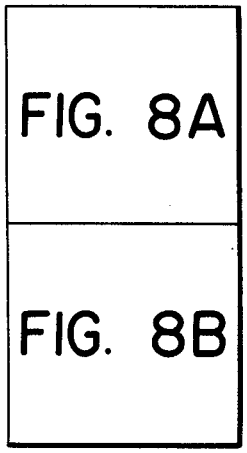
Figure 9:
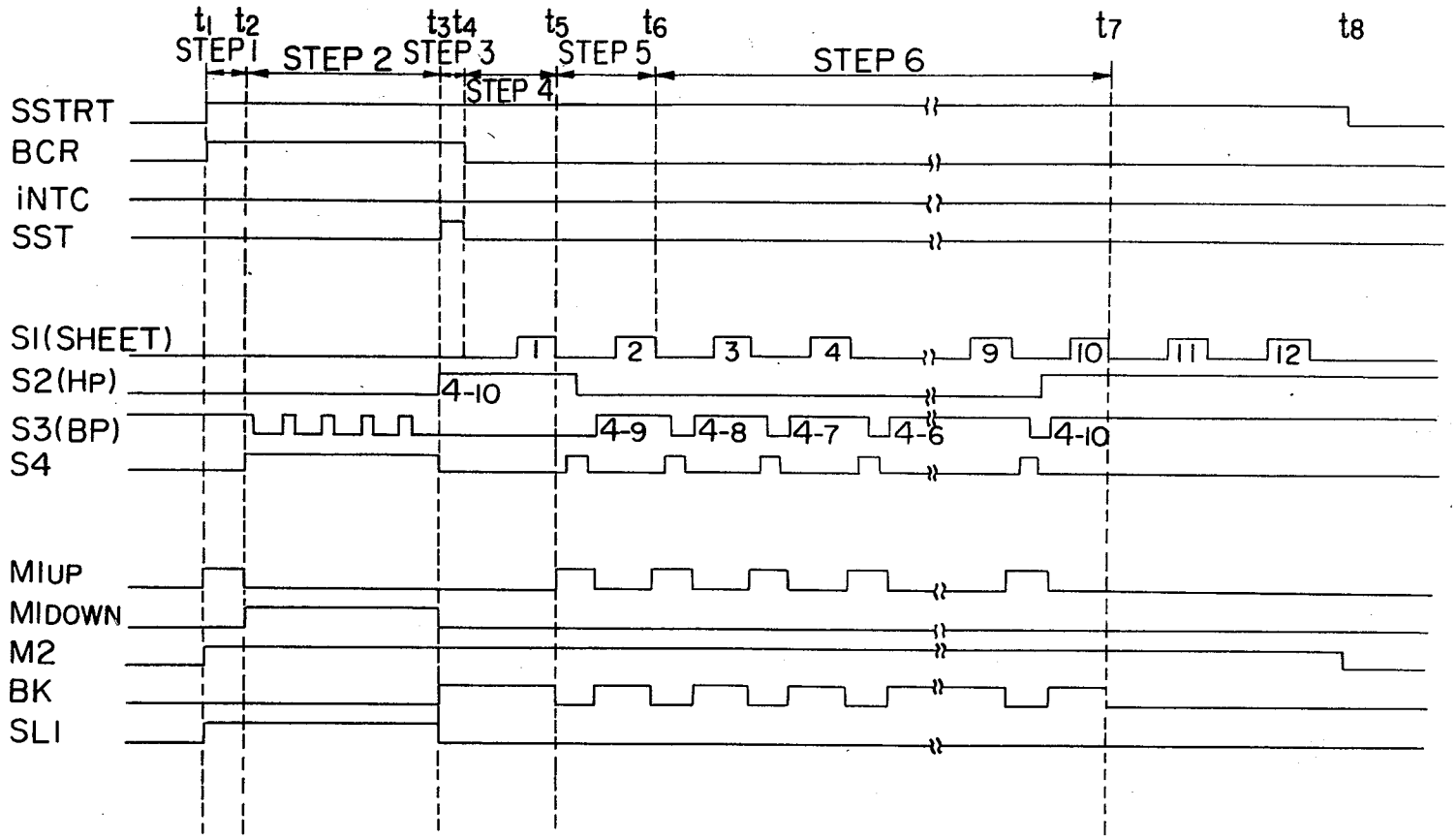
FIGS. 9, 11 and 13 are timing charts.

FIG. 8 is a control flow chart of a soft program stored in the ROM of the sorter controlling CPU. FIG. 9 is a timing chart of the respective apparatus portions controlled by the flow chart. Operation will hereinafter be described.

When a copy key (not shown) is depressed, the sorter start signal SSTRT from the copying apparatus controlling CPU becomes "1" and the motor M2 which is the drive source for the movable rollers 2, 3 and the conveyor roller 22 is energized. Thereafter, if the interruption demand signal INTC from the copying apparatus is ON, the program jumps to Ⓒ. If said signal INTC is not ON, a tray return signal BCR becomes "1" and a driving signal is put out from an output terminal O2 to the relay SSRU to temporally lift the tray group and the motor M1 is energized (revolved in clockwise direction). By this, the tray group is temporally lifted. Plunger SL1 is also energized to release the pawl 51 and the release of the pawl is detected by the pawl release detecting sensor 53' and the rising of signal S4 is waited for (step 1).

When the pawl 51 is released and signals S4 becomes "1", the program proceeds to step 2 and the relay SSRU becomes OFF. A driving signal is put out from an output terminal 03, the relay SSRD becomes ON and the motor M1 revolves in counter-clockwise direction. By this, the tray group is lowered. Signals S2 and S3 become "1" and "0", respectively, and the tray group is stopped when the tray 4-10 comes to the nip between the movable rollers 2 and 3.

When signals S2 becomes "1", the program proceeds to step 3, at which the relay SSRD is deenergized to stop the motor M1 and deenergized the plunger PL1. The electromagnetic brake BK is operated. This brake is a non-excited type brake and is operated when no power is supplied to the motor, to prevent the tray group from falling naturally due to power stoppage. Sorter stand-by signal SSTBY is put out from the output terminal $O_0$ to the copying apparatus 24. This continues until the tray return signal BCR from the copying apparatus 24 falls.

When the sorter stand-by signal SSTBY becomes OFF, the program proceeds to step 4, at which check-up of the jam of a sheet detected by the sheet detecting sensor 17 is effected. That is, the leading and trailing ends of the sheet are detected by the sheet detecting sensor 17 and if the time required therefor is longer than a predetermined time, it is judged as jam and a jam signal is put out from the output terminal 01 of the sorter controlling CPU to the copying apparatus controlling CPU. If there is no jam, the electromagnetic brake BK is deenergized to change over the tray to the next tray 4-9 and the motor M1 is energized through the relay SSRU to lift the tray group.

At step 5, the position detecting sensor 16B detects the cut-away groove 15 corresponding to each tray and when the signal S3 rises, the motor M1 is stopped and the electromagnetic brake BK is energized. Check-up of the jam of the next sheet is then effected as previously described.

When the sheet detecting sensor 17 detects the trailing end of the sheet, the program proceeds to step 6, at which whether the tray lying at the nip between the movable rollers 2 and 3 is the tray 4-1 is judged by signals S2 and S3. That is, whether both signals S2 and S3 are "1" is judged.

If one of the signals S2 and S3 is not "1", it is judged that the tray group has not reached its uppermost position. Whether there is an interruption demand is judged and if there is an interruption demand, the program jumps to Ⓒ. If there is not interruption demand, whether the signals SSTRT is "1" is judged and, if it is "1", the program jumps to Ⓑ and if it is not "1", the program returns to the initial step. Also, if both signals S2 and S3 are "1" and the tray 4-1 has been selected, the brake BK is deenergized and whether the signals SSTRT is "1" is judged and if it is "1", the program jumps to Ⓒ and if it is not "1", the program returns to the initial step.

That is, by detecting the trailing end of each sheet conveyed out of the copying apparatus, the energizing operation of the motor M1 and the deenergizing operation of the brake are repeated and the fact that the tray 4-1 has been selected is judged by the signals S2 and S3 of the tray position detecting sensors 16A and B, whereupon the movement of the tray group is stopped. If, at this time, the signal SSTRT is still put out and a sheet has been carried out of the copying appara- tus, that sheet is received into the tray 4-1 and the signal SSTRT becomes OFF, whereby the motor M2 is stopped to stop the movable rollers 2 and 3. Thereby, the sorter is stopped.

While the present embodiment is of such a construction that the tray group is temporally lowered to its lowermost position and the tray group is moved upwardly each time a sheet is carried outwardly, design may also be made such that the tray group is temporally moved up to its uppermost position and the tray group is moved downwardly each time a sheet is carried outwardly.

Also, in the present embodiment, a photointerrupter has been employed as the sensor, but the sensor may also comprise a microswitch.

In this manner, by detecting the release of the tray falling preventing pawl, downward movement of the trays is effected and this leads to the possibility of stable and reliable movement of the trays.

Also, two different tray position indicating portions formed on a moving member vertically movable with a paper leaf receiving portion are detected by two position detecting members and the operation control of the paper leaf containing portion is effected by the two encoded detection signals, whereby the position detection of the paper leaf receiving portion can be accomplished with high accuracy and the reception or feeding of paper leaves can be achieved accurately and stably.

Also, such a position detecting method may be applied to a paper feeding station so that a container unit having a plurality of cassettes or the like containing different sizes of sheets therein may be moved up and down in accordance with the sheet size selected by the operator and the container unit may be stopped by detecting that a cassette containing a desired size of sheets therein has come to the sheet conveying path position, whereupon sheets may be fed from that cassette by a copy instruction.

Figure 10A:
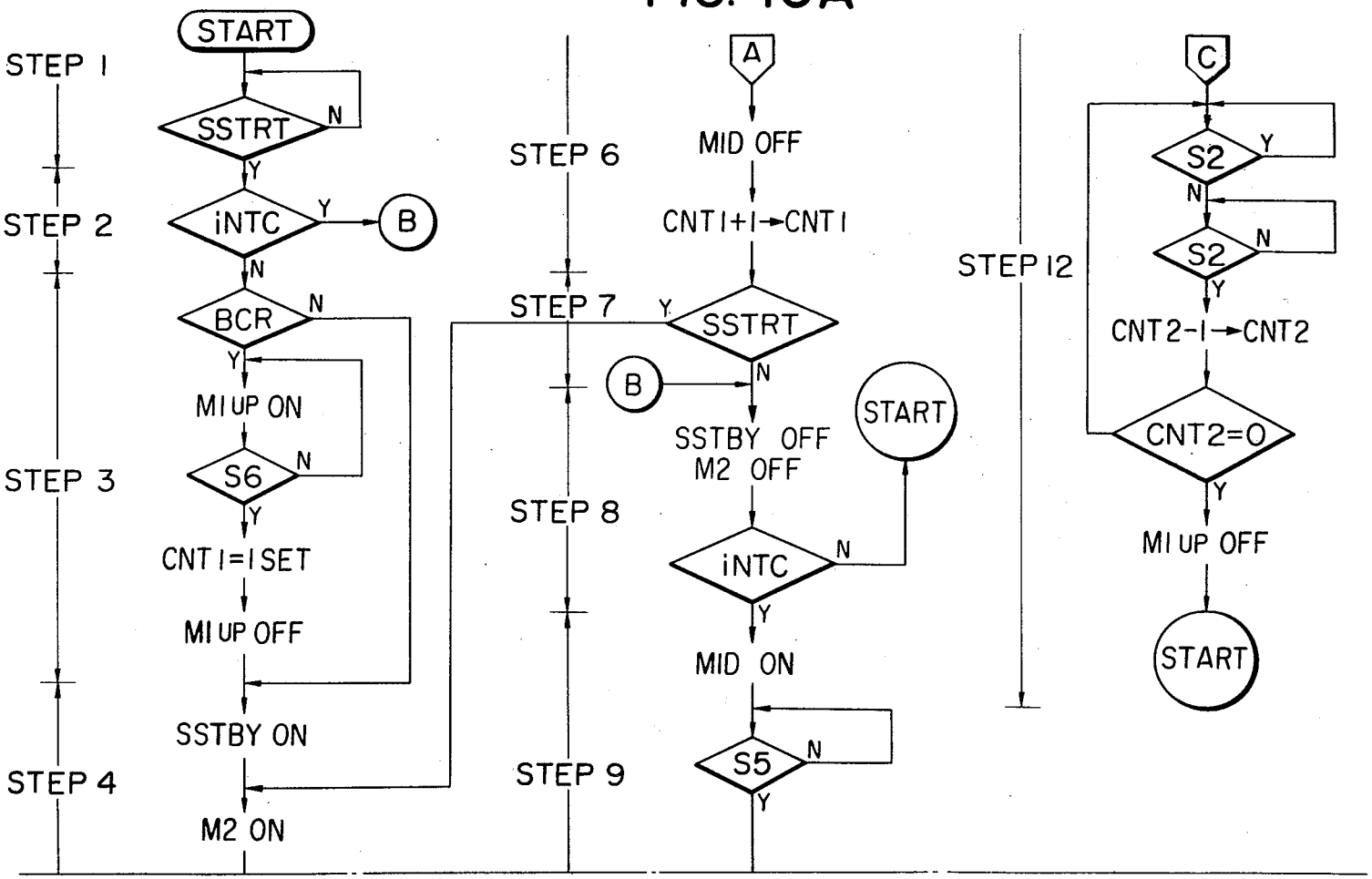
Figures 10, 10B:
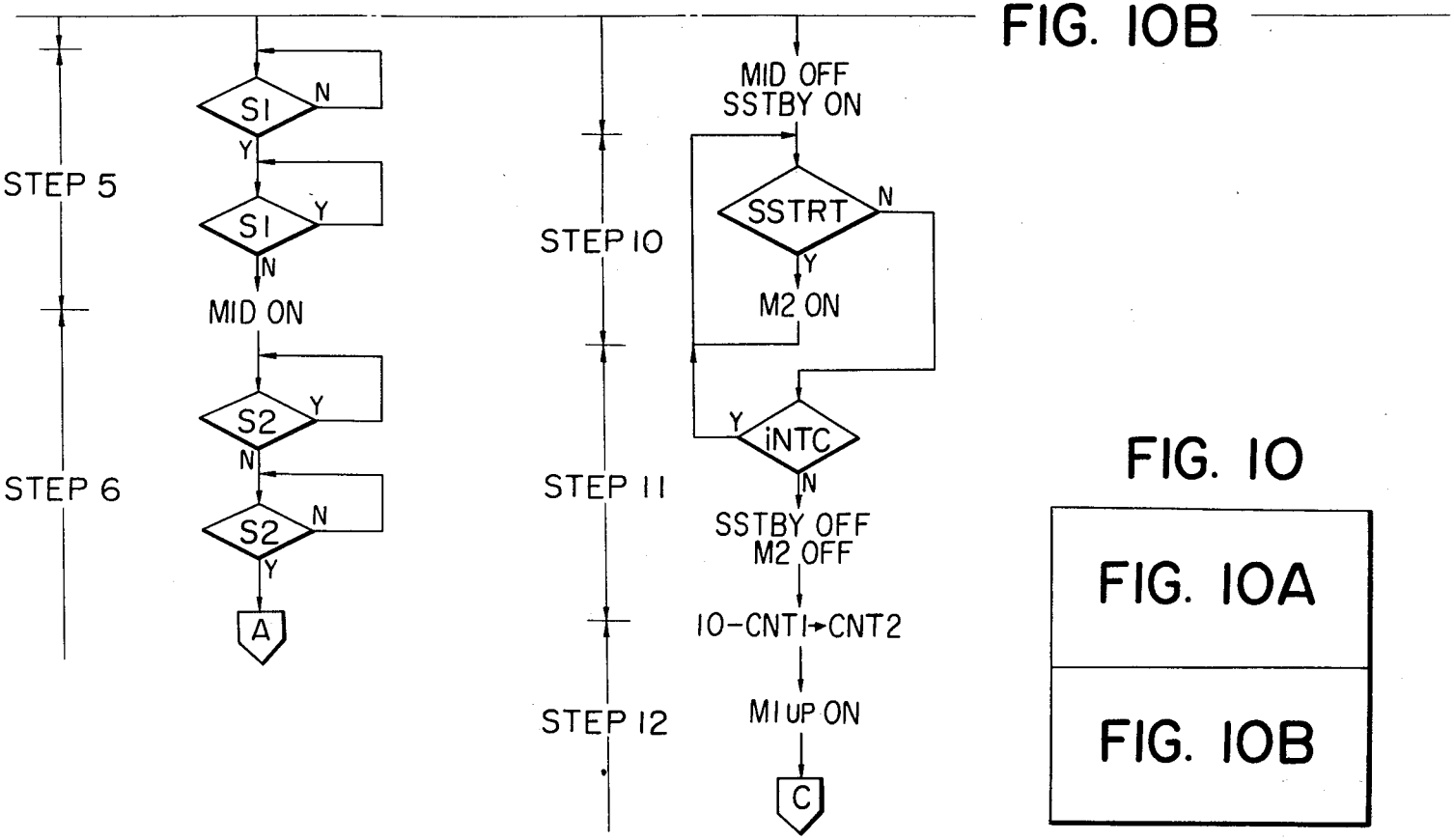
Figure 11:
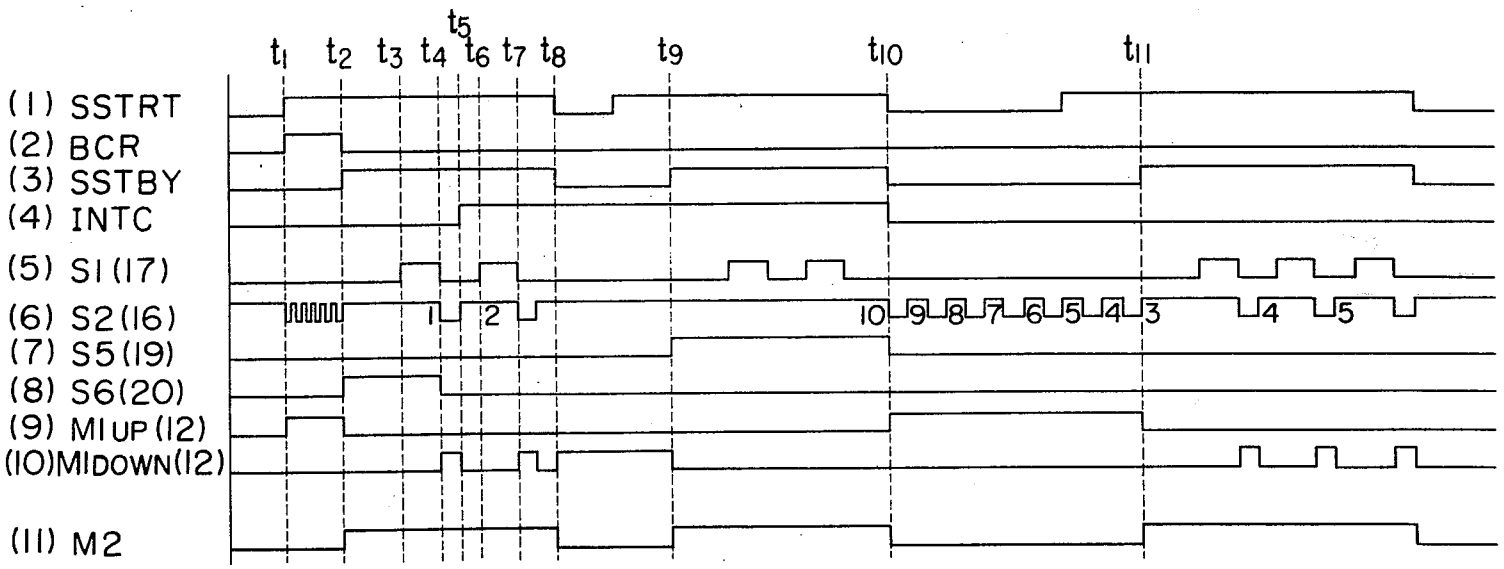

Reference is now had to the flow chart of FIG. 10 and the timing chart of FIG. 11 to describe the control of the sorter during interruption copying.

At step 1, whether sorter start signal SSTRT is applied as input to the input terminal I0 of CPU from the copying apparatus 24 is judged and if the signal is so applied, the program proceeds to step 2. At step 2, the operation of the sorter is changed depending on whether the interruption signal INTC from the copying apparatus has come in. The interruption signal INTC temporally interrupts the then copying when the copying apparatus receives an interruption demand, and again continues the interrupted copying after the copying for the interruption demand has been effected. At this time, the program jumps to Ⓑ .

The timing chart of FIG. 11 indicates a case where when copying on five sheets is going on, there is an interruption demand for two copies after completion of two copies and this is executed, whereafter the remaining three sheets are subjected to sorting. At time t1, the program proceeds to step 3.

When sorter return signal BCR is put out from the copying apparatus 24 at step 3, a driving signal is put out from the output terminal 01 so that the tray 4-1 may come to the nip between the movable rollers 2 and 3, and this driving signal drives the motor M1 through the relay SSRU to lift the tray group. This signal BCR is put out by the copying apparatus body controlling as to whether sorting should be continued as in the case where jam or absence of paper occurs or whether sorting should be effected from the first tray 4-1. When the tray upper end detecting sensor 20 detects the tray 4-10, signal S4 becomes "1". Thereby, the motor M1 is stopped. Also, to memorize the position of the tray group, a counter CNT1 constituted by an unshown RAM in the sorter controlling CPU is set to 1. The motor M1 has an electromagnetic type brake which is operable when no power is supplied to the motor, and prevents the tray group from falling naturally due to power stoppage.

At step 4, sorter stand-by signal SSTBY is put out from the output terminal $O_0$ of the sorter controlling CPU to the copying apparatus body controlling CPU. By this, the copying apparatus 30 starts paper feeding. Also, a driving signal is put out from the output terminal 03 of the sorter controlling CPU to energize the motor M2 which drives the movable rollers 2 and 3. At step 5, the sheet detecting sensor 17 detects the leading end of a sheet at time t3 and detects the trailing end of the sheet at time t4 and, when the signal S1 thereof falls, the sheet completely enters into the tray 4-1 and therefore, to set the tray 4-2 to the nip between the movable rollers 2 and 3, the motor M1 is energized through the relay SSRD to lower the tray group. At step 6, the tray group is moved downwardly, whereby the output signal S2 of the position detecting sensor 16 changes from ON to OFF and, when the next tray 4-2 is detected, the signal S2 again becomes ON to deenergize the motor M1 to stop the lowering of the tray group. Then the content of the counter CNT1 constituted by the RAM of the sorter controlling CPU and having memorized the position of the tray group is incremented to 2. At step 7, the presence of sorter start signal SSTRT is checked up and whether paper has been fed is judged. In the timing chart of FIG. 11, interruption is exerted on the body at time t5, but the copying apparatus keep signal SSTRT on until it completes the copy now being processed. Accordingly, one more copy comes out and therefore, the program returns to step 4 and the second sheet is processed at steps 4–6. At this time, the counter is CNT1=3. That is, after the interruption has been processed, operation starts from the tray 4-3. At step 8, signal SSTRT becomes OFF at time t8, whereby sorter stand-by signal SSTBY becomes OFF and the motor M2 is deenergized, whereupon the sorter stops operating. If there is no interruption signal INTC, the program will return to the initial stage START and wait for the next control signal, but here INTC is ON and therefore, the program proceeds to step 9. At step 9, interruption is exerted after two copies and therefore, the motor M1 is energized through the relay SSRD to lower the tray group so that the non-sort tray 4-10 comes to the nip between the movable rollers 2 and 3. The tray lower end detecting sensor 19 detects the tray 4-1 and the tray group is lowered until the detection signal S5 becomes ON, whereupon the motor M1 is deenergized. Then, signal SSTBY representative of the completion of preparation of the sorter is supplied to the copying apparatus. Thereupon, the copying apparatus starts copying. In the time chart of FIG. 11, two sheets of paper are being fed. At step 10, the tray 4-10 receives a sheet and the interruption copying is terminated in the copying apparatus body and, when signal SSTRT becomes OFF, the program proceeds to step 11 and, if there is an interruption demand again, the program will return to step 10. If there is no interruption demand, sorter stand-by signal SSTBY becomes OFF and the motor M2 is deenergized.

At step 12, the tray group is returned to its position occupied before the interruption. For this purpose, the operation of 10-CNT1 is effected and the result thereof is stored in a counter CNT2 formed in the RAM of the sorter controlling CPU. In this case, CNT1=3 and therefore, CNT2=7. The motor M1 is energized through the relay SSRU to lift the tray group. Each time the output signal S2 of the position detecting sensor 16 falls, the counter CNT2 is decreased and this is repeated until the counter CNT2=0, whereupon the motor M1 is deenergized to stop the tray group. At this time (time t11), the tray 4-3 is positioned at the nip between the movable rollers 2 and 3. Then the program returns to the initial step. At this time, signal SSTRT is already ON and therefore, the program proceeds to steps 2 and 3. Signal BCR is OFF at step 3, and so, the program jumps to step 4, at which sorter stand-by signal SSTBY is supplied to the copying apparatus body. Copying on the remaining three sheets is effected and these sheets are successively received into the trays 4-3, 4-4 and 4-5.

The above-described embodiment is of such a construction that sheets are received into a particular tray during interruption copying design may also be made so that interruption copies are received into the tray next to that tray into which the sheet conveyed out immediately before commencement of interruption copying is received.

Figure 12:
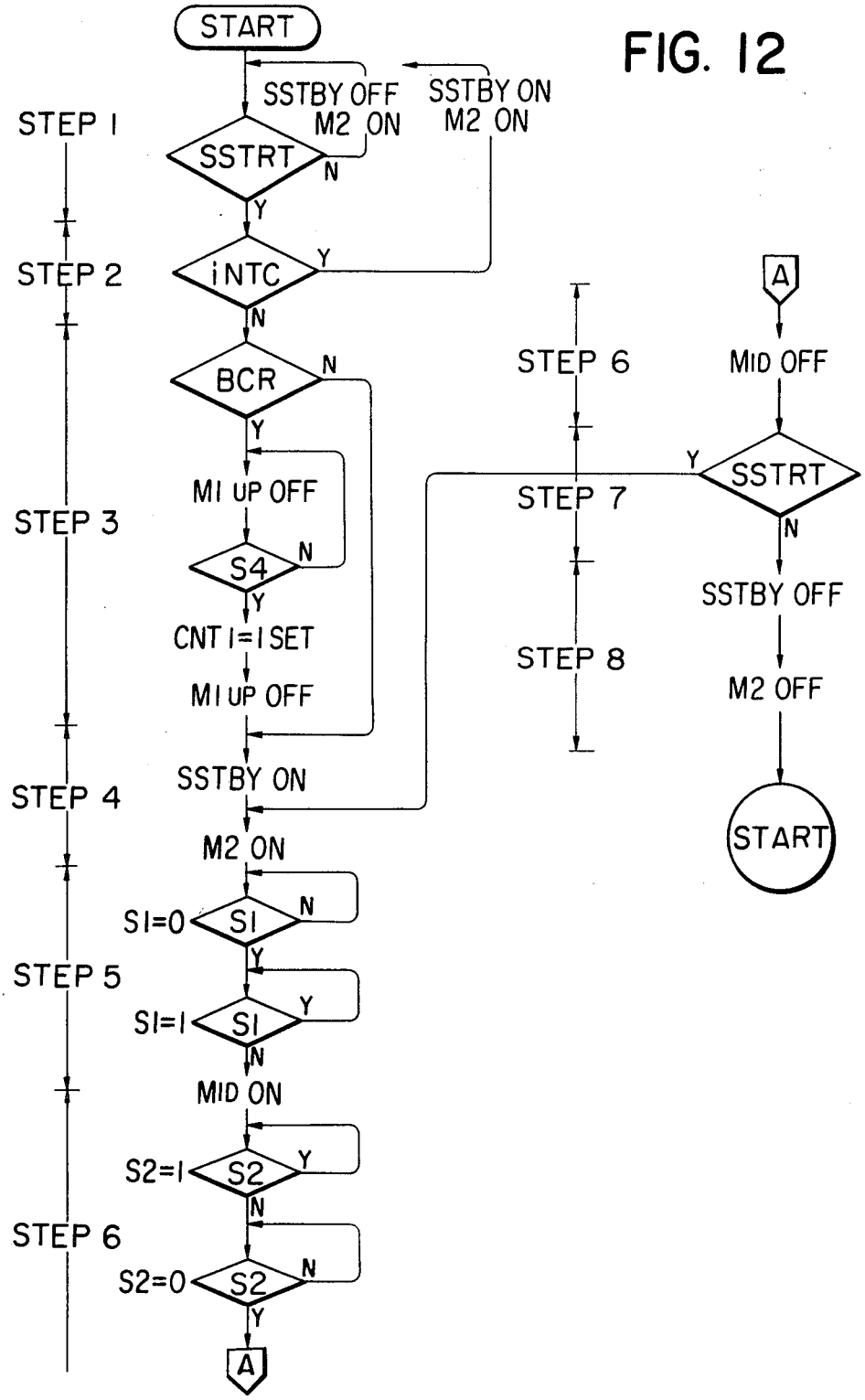
Figure 13:
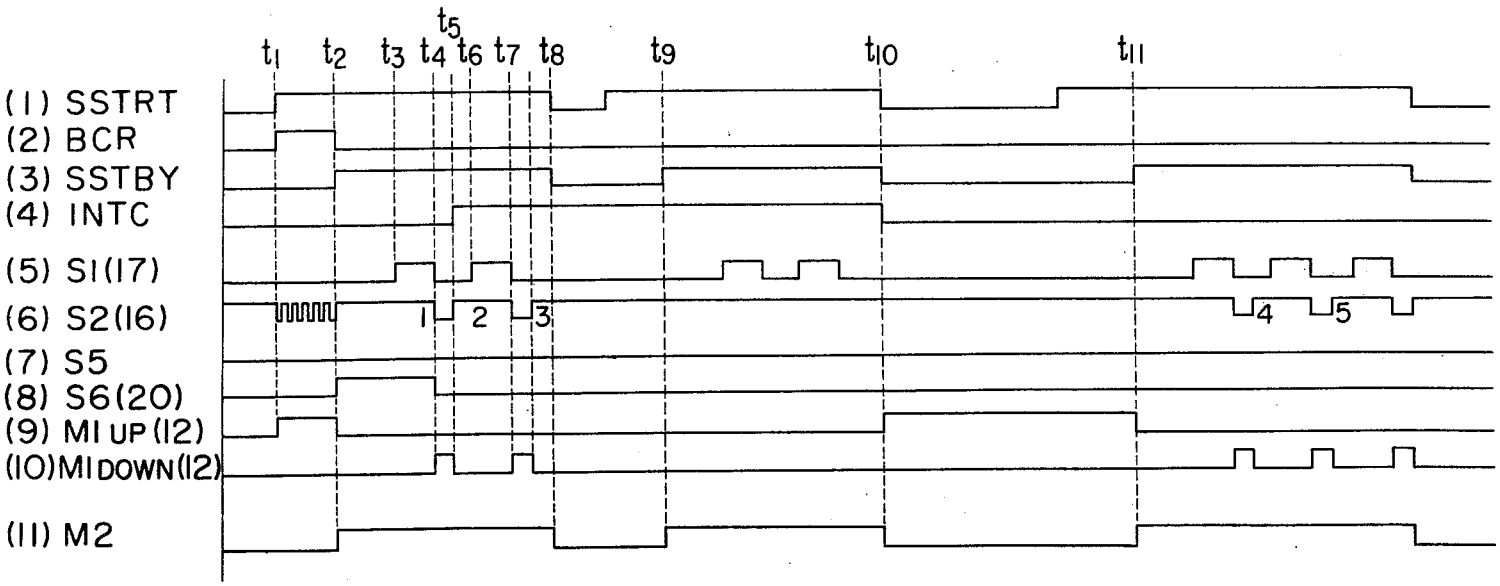

An example thereof will now be described by reference to the flow chart of FIG. 12 and the timing chart of FIG. 13. Steps 2–5 carry out an operation similar to what has been previously described.

Subsequently, at step 6, the tray group is moved downwardly, whereby the signal from the tray group position sensor 16 changes from ON to OFF and the tray 4-2 comes to the nip between the movable rollers 2 and 3, whereupon signals S2 again becomes ON, and the motor M1 is deenergized.

At step 7, whether sorter start signal SSTRT has again become ON, namely, whether a sheet is being conveyed, is judged. In the example shown in the timing chart of FIG. 13, an interruption demand is exerted on the copying apparatus body at time t5, but signal SSTRT does not become OFF until the copying operation of the copying apparatus is terminated and therefore, the program returns to step 4 to complete the processing of the second sheet and executes steps 4–6.

At step 8, signal SSTRT becomes OFF at time t8 and signal SSTBY becomes OFF and the motor M2 is deenergized. By this, the sorter is stopped. Interruption signal INTC is ON and therefore, the program proceeds to step 9.

At step 9, the tray group stops moving for the purpose of interruption copying and receives sheets alone. That is, the motor M2 is energized to rotate the rollers 2 and 3 and signal SSTBY is supplied to the body to start paper feeding. Upon termination of the interruption copying, the program waits for the next control signal in the loop of step 1. Signal SSTRT becomes ON upon arrival of the next copy signal and the program proceeds to steps 2 and 3 and at step 3, the copying after the interruption occurs and therefore, signal BCR does not come out, and thus the program jumps to step 4. Thereafter, from step 4, an operation similar to what has been previously described is effected for the third copy and so forth until five copies are completed.

Design may also be made such that a tray capable of containing sheets of a larger size than the size of the sheets contained in the other trays is provided in the tray group and paper is received into this tray when the larger paper size has been selected by the paper size signal from the copying apparatus.

Figure 14:
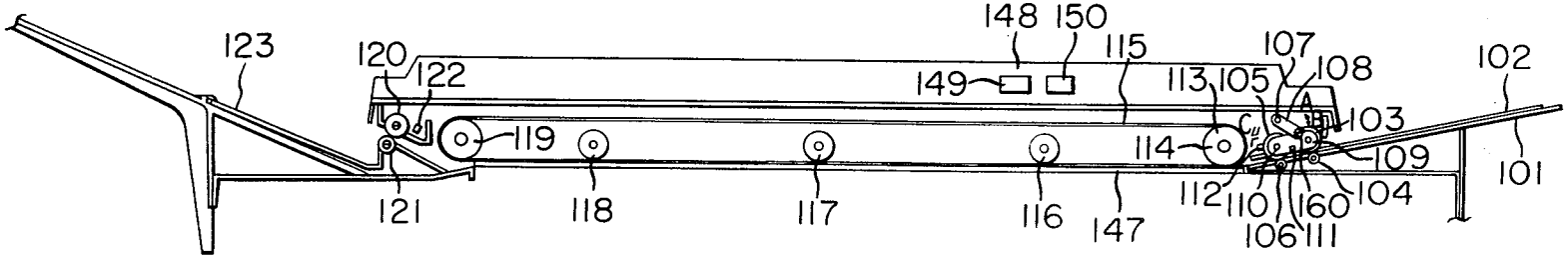
FIG. 14 is a cross-sectional view of an automatic sheet original feeding device.

An automatic sheet original feeding device is sometimes used with a copying apparatus to feed sheet originals one by one to the original supporting surface thereof. FIG. 14 is a cross-sectional view of an embodiment of such an automatic sheet original feeding device. In FIG. 14, reference numeral 101 designates a feeding tray on which sheet originals are piled one by one. Sheet originals 102 on the feeding tray 101 are piled with the front surface thereof (that surface which is to be copied) facing downwardly. A pick-up roller 103 is formed of a material such as rubber having a great friction coefficient and is pivotable in the direction A-B about a feed roller shaft 110. A feed roller 105 (formed of the same material as the pick-up roller) is fixed to the feed roller shaft 110 and, as the feed roller shaft 110 is rotated, the feed roller is rotated therewith and this rotation is also transmitted to the pick-up roller 103 by a gear, so that the feed roller 105 and the pick-up roller 103 are rotated in the same direction and at the same peripheral speed. A paper feed roller 104 has its rotary shaft secured to the paper feeding tray 101 and is designed to follow the original 102 when the original 102 inserted between the pick-up roller 103 and the paper feed roller 104 is conveyed with the pick-up roller 103 urged thereagainst.

Another paper feed roller 106 is designed to slide so as to provide an urging force toward the paper feed roller shaft 110 and also to follow the sheet original when it passes between the feed roller 105 and the feed roller 106. A pick-up arm 108 is pivotable about a pick-up arm shaft 107 and one end thereof is formed with a U-shaped groove and is fitted to a shaft 160 pivotable about the feed roller shaft 110 and secured to a paper feed arm 109. When the pick-up arm shaft 107 is pivotally moved counter-clockwise, the pick-up arm 108 pivots counter-clockwise (the direction of arrow A) and the paper feed arm 109 also pivots counter-clockwise about the feed roller shaft 110. At this time, the pick-up roller 103 becomes separated from the feed roller 104.

Next, when the pick-up arm shaft 107 is pivotally moved clockwise, the pick-up arm 108 pivots clockwise and the paper feed arm 109 also pivots clockwise about the feed roller shaft 110. At this time, the pick-up roller 103 which has so far been separated from the feed roller 104 is urged against the feed roller 104, thus becoming ready to feed the sheet original 102 while holding the sheet original between the pick-up roller and the feed roller. Reference numeral 111 designates a reflection type sensor for detecting the presence of a sheet original, and reference numeral 112 denotes a reflection type sensor for detecting the leading end of a sheet original. The sensor 111 is called the original presence detecting sensor and the sensor 112 is called the leading end detecting sensor.

A whole surface belt 115 is an endless belt of such a size as to cover the whole surface of an original supporting table 147, and the surface thereof is coated with a rubber material having a sufficient friction coefficient to convey the originals with a friction force. The surface of the belt 115 is also treated so that any stain adhering thereto can be removed by alcohol or the like. This whole surface belt 115 is passed over a drive roller 113 and a turn roller 119, which is so constructed at the left-hand side of FIG. 14 that a force is applied to the shaft thereof so as to enable the belt to have a sufficient tension to prevent any slip from occurring between the drive roller 113 and the whole surface belt 115. Keep rollers 116, 117 and 118 are provided inside the whole surface belt 115, and the intervals between the feed roller 105 and the keep roller 116, between the keep rollers 116 and 117, between the keep rollers 117 and 118 and between the keep roller 118 and a paper discharge roller 120 and selected to a pitch somewhat narrower than the size of conveyable sheet original. Each roller urges the whole surface belt 115 against a original platen glass 147 with a weak pressure and increases its conveyance force when a sheet original passes between the original platen glass 147 and the whole surface belt 115.

A discharge detecting sensor 122 is a reflection type sensor which detects the discharge of sheet originals and causes a jam lamp to be turned on if no original passes for a predetermined time. The paper discharge roller 120 is pressed by a discharge roller 121 so that sheet originals, the copying of which has been completed on the original platen glass 147, can be discharged while being held therebetween.

The discharge roller 121 follows the movement of a sheet original.

Figure 15:
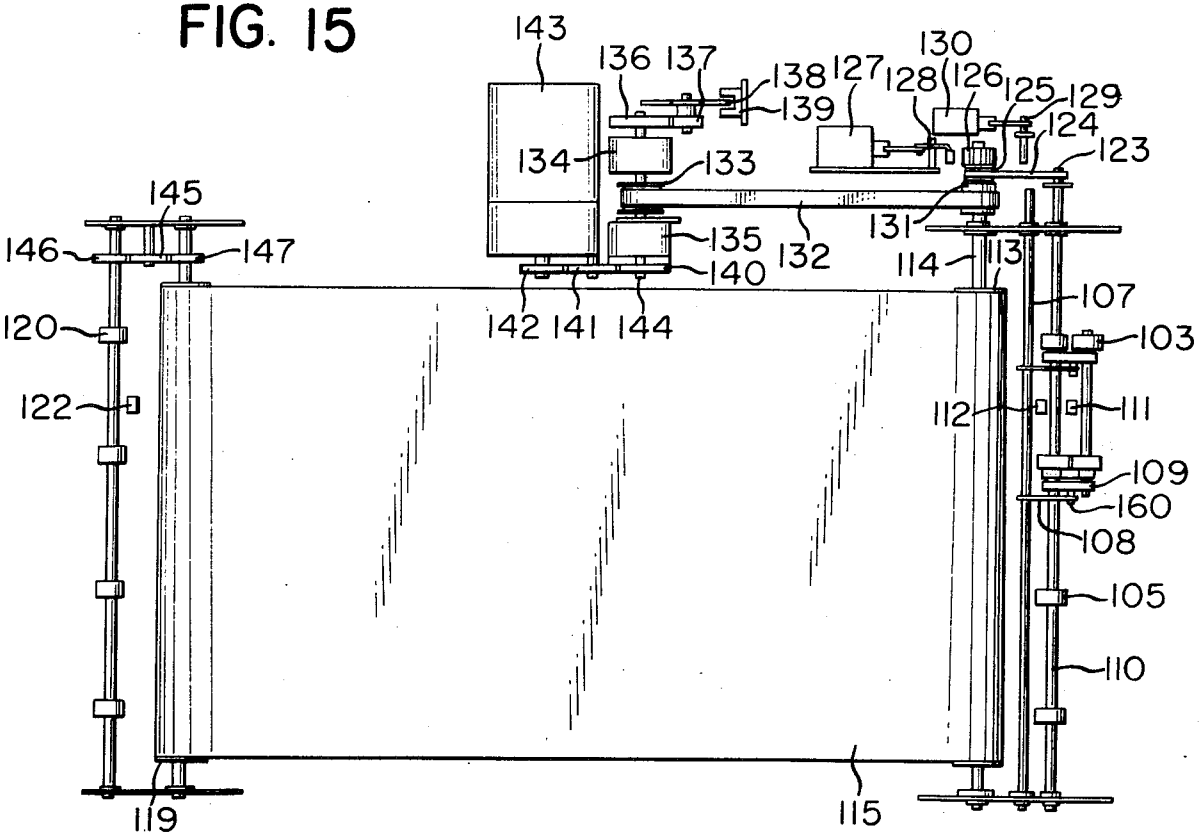
FIG. 15 is a plan view of the driving portion of the FIG. 14 device.

The originals discharged by the paper discharge roller 120 are successively loaded onto a paper discharge tray 123. The discharge roller 121 is knurled to ensure the loading of originals onto the paper discharge tray 123. The driving unit for the above-described device will now be described by reference to FIG. 15.

A drive gear 142 is secured to the rotary shaft of a motor 143, the drive of which is transmitted to a gear 140 through an idler gear 141. The rotation of the gear 140 is transmitted to a clutch shaft 144 by the connection of an electromagnetic clutch 135 to rotate the clutch shaft 144. An electromagnetic brake 134 serves to stop the rotation of the clutch shaft 144 and, when power is supplied to the electromagnetic brake 134, the rotation of the clutch shaft 144 is stopped. A gear 136 is secured to the shaft 144 and rotates as the clutch shaft 144 is rotated, and the gear 136 transmits its rotation to a clock disc 138 and increases the speed of its rotation and rotates the clock disc 138. The clock disc 138 has fine grooves on the circumference thereof and a photointerrupter 139 reads the number of the grooves and counts the clock number. The rotation of the clutch shaft 144 is transmitted to a driving roller shaft 114 by a belt 132 passed over a drive pulley 133 secured to the clutch shaft 144 and a follower pulley 131 secured to the driving roller shaft 114. A pulley 125 is mounted on the driving roller shaft 114 through a spring clutch, and ON-OFF of the drive transmission is effected by a plunger 127 controlling a spring clutch control ring 126 through a clutch pawl 128. A pulley 123 receives the transmission of the rotation of the pulley 125 through a belt 124 and is mounted on the feed roller shaft 110 through a one-way clutch.

The ratio of the diameters of the pulleys 125 and 123 is selected so that the peripheral speed of the whole surface belt 115 is slightly higher than the peripheral speed of the feed roller 105. The pulley 123 and the feed roller shaft 110 are one-way coupled to each other so that the feed roller 105 follows the sheet original 102 when the sheet original has become nipped by the whole surface belt 115 and assumed the same speed as the latter. The feed roller 105 and the pick-up roller 103 are gear-coupled so as to rotate in the same direction and at the same peripheral speed. A plunger 130 causes a lever 129 to pivotally move the pick-up arm shaft 107 thereby effecting vertical movement of the pick-up roller 103. Operation of the above-described construction will now be described.

When the sheet original 102 is placed on the original feeding tray 101 and inserted between the pick-up roller 103 and the paper feed roller 104, the original presence detecting sensor 111 detects the sheet original, and a predetermined time after that, power is supplied to the plunger 130 to lower the pick-up roller 103 and the sheet original is nipped between the pick-up roller 103 and the paper feed roller 104 (in the absence of the sheet original, the pick-up roller 103 is in its raised position). When a predetermined time T2 elapses after power has been supplied to the plunger 130, the motor 143 revolves and power is also supplied to the clutch 135 and the drive roller 113 is rotated. In this condition, no power is supplied to the plunger 127 and the pulley 125 remains stationary by the action of the spring clutch, and thus the sheet original is not conveyed. When a predetermined time T3 elapses after the motor has begun to revolve, power is supplied to the plunger 130 and the clutch pawl 128 becomes disengaged from the control ring 126, so that the rotation of the driving roller shaft 114 is transmitted to the feed roller shaft 110 to rotate the feed roller 105 and the pick-up roller 103. At this time, the sheet original 102 begins to be conveyed.

When the leading end of the sheet original 102 has passed between the feed roller 105 and the feed roller 106, the leading end of the sheet original 102 is detected by the leading end detecting sensor 112 and from this time, the photointerrupter 139 begins to count the clock number of the clock disc. Subsequently, the sheet original 102 enters into between the whole surface 115 and the original platen glass 147 and, when the leading end of the original comes under the keep roller 116, the conveying force of the whole surface belt 115 is increased and the sheet original 102 assumes the same speed as the peripheral speed of the whole surface belt 115 which is higher than the peripheral speed of the feed roller 105, and the feed roller 105 now follows the sheet original. When the trailing end of the sheet original 102 is detected by the paper presence detecting sensor 111, the power supply to the plunger 130 is cut off and the pick-up roller 103 moves upwardly. Also, as soon as the trailing end of the sheet original 102 is detected by the leading end detecting sensor 112, the power supply to the plunger 127 is cut off, whereupon the rotation of the feed roller 105 and of the pick-up roller 103 is stopped. This is for not receiving the next sheet original.

The power supply to the motor 143 is cut off when the leading end of the original is detected by the leading end detecting sensor 112 and the photointerrupter counts a predetermined clock number, and at the same time, the power supply to the clutch 135 is cut off and power is supplied to the brake 136 is stop the clutch shaft 144 momentarily. Thereby, the rotation of the driving roller shaft 114 and the movement of the whole surface belt is stopped momentarily and the sheet original 102 comes to a halt at a predetermined position on the original platen 147. Immediately thereafter, copy start signal is supplied to the copying apparatus body to start copying. The power supply to the brake 136 is cut off after a predetermined time.

The motor 143 begins to revolve by copy termination signal and power is supplied to the clutch 135, whereupon the whole surface belt 115 begins to discharge the sheet original 102, which is nipped between the discharge roller 120 and the discharge roller 121 and discharged onto the paper discharge tray 123.

When the original presence detecting sensor 111 is sensing the next original, power is supplied to the plunger 127 after the discharge detecting sensor 122 has detected the leading of the sheet original 102, and the sheet original is fed in the same manner as that described above.

Figure 16:
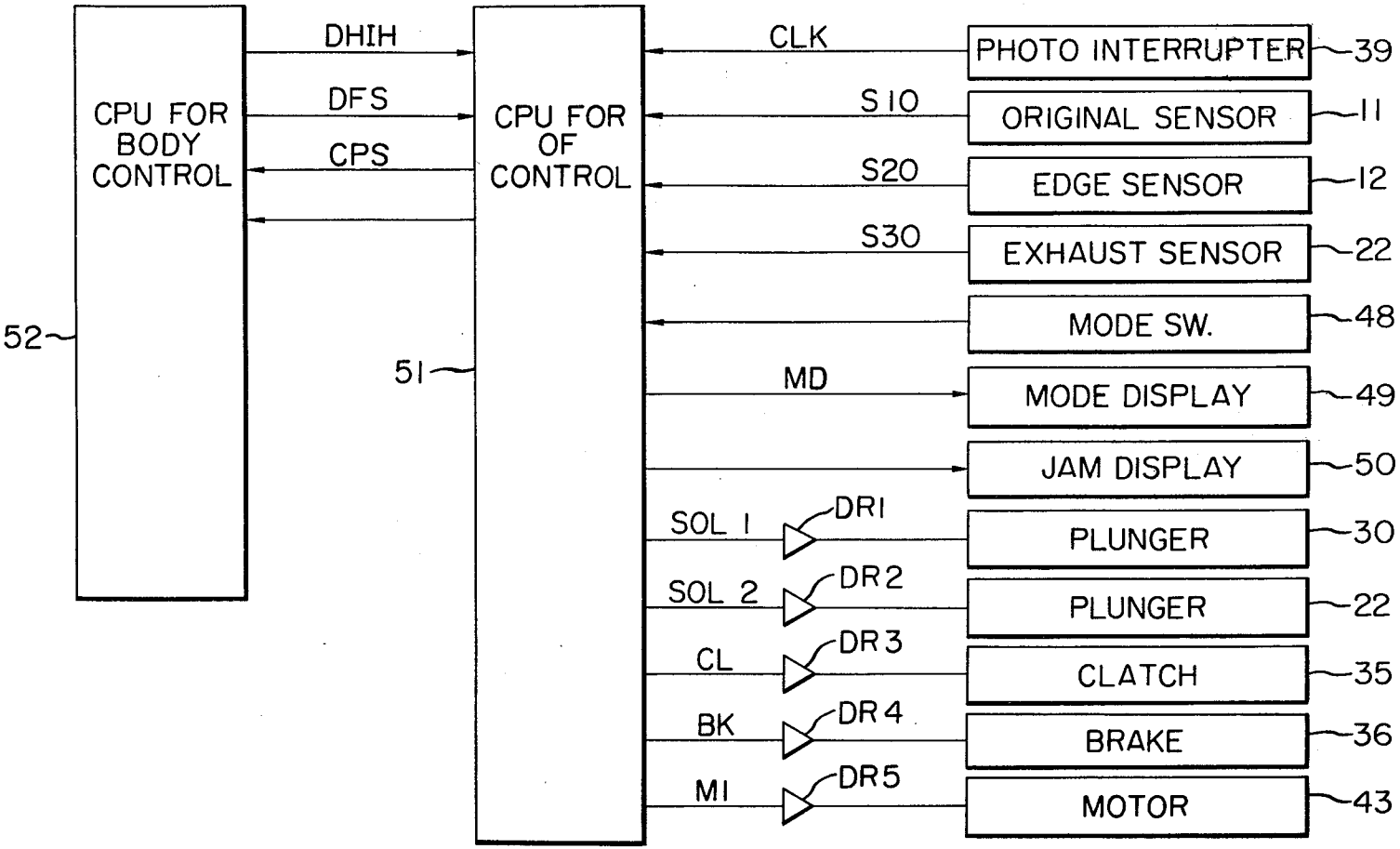
FIG. 16 is a diagram of a control circuit according to an embodiment of the present invention.

FIG. 16 shows an example of the control circuit for effecting the previously described operation. The control circuit comprises chiefly the controlling CPU 52 of the copying apparatus body and the controlling CPU 51 of the automatic original feeding device (hereinafter referred to as DF). The DF controlling CPU 51 and the body controlling CPU 52 are one chip microcomputers containing well-known ROM, RAM, etc. therein, and for example, μCOM43 produced by Nippon Denki Co., Ltd. may be used as such.

Copy start signal CPS and copy inhibiting signal CPIH which is generated when jam has occurred in DF are transmitted from the DF controlling CPU51 to the body controlling CPU 52. Also, DF operation inhibiting signal DFIH and DF start signal DFS which is generated upon termination of copying are transmitted from the body controlling CPU 52 to the DF controlling CPU 51.

Also applied as inputs to the DF controlling CPU are the clock CLK from the photointerrupter 139, the original detection signals S10, S20 and S30 from the sensors 111, 112, and 122 and the switch condition signal of a mode switch 148. The turn-on signal MD1 of a mode lamp 149, the turn-on signal of a jam display lamp 150 and the drive control signals SOL1, SOL2, CL, BK and M of the original keep plunger 130, original feeding plunger 127, clutch 135, brake 136 and motor 143, respectively, are put out through drivers DR1–DR5.

Figure 17A:
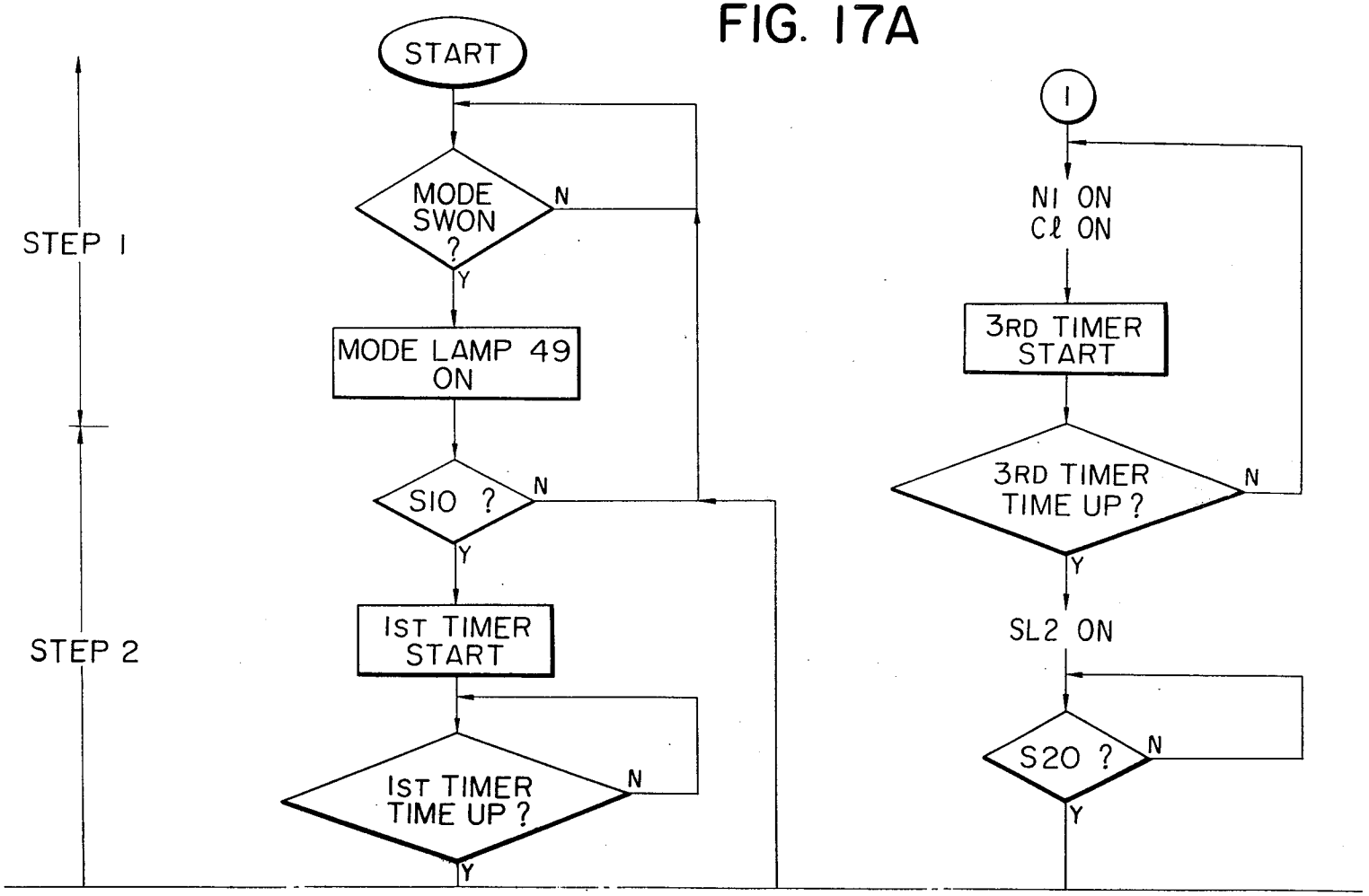
FIGS. 17, 17A, 17B is a flow chart of the program stored in a DF controlling CPU.
Figures 17, 17B:
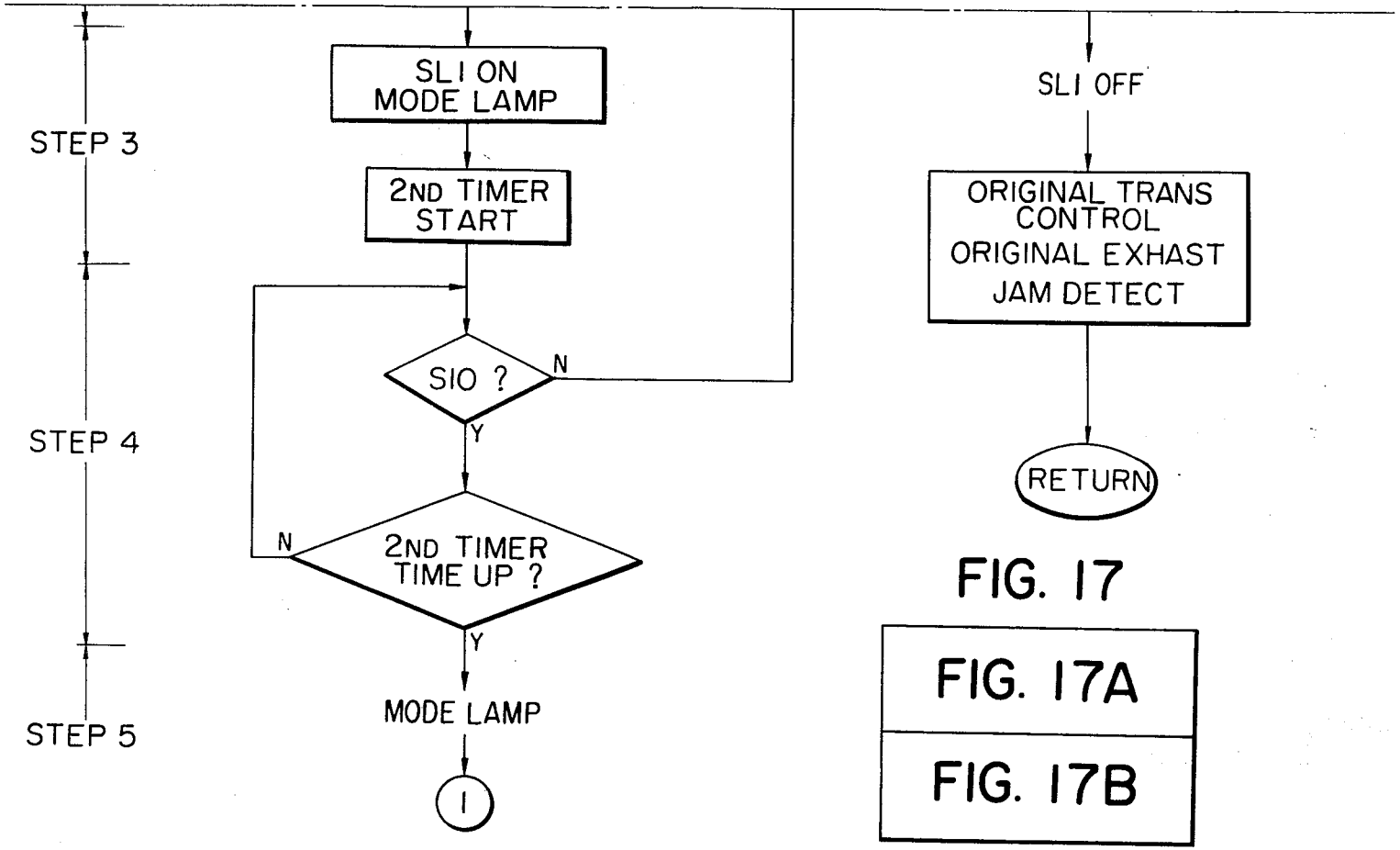
Figure 18:
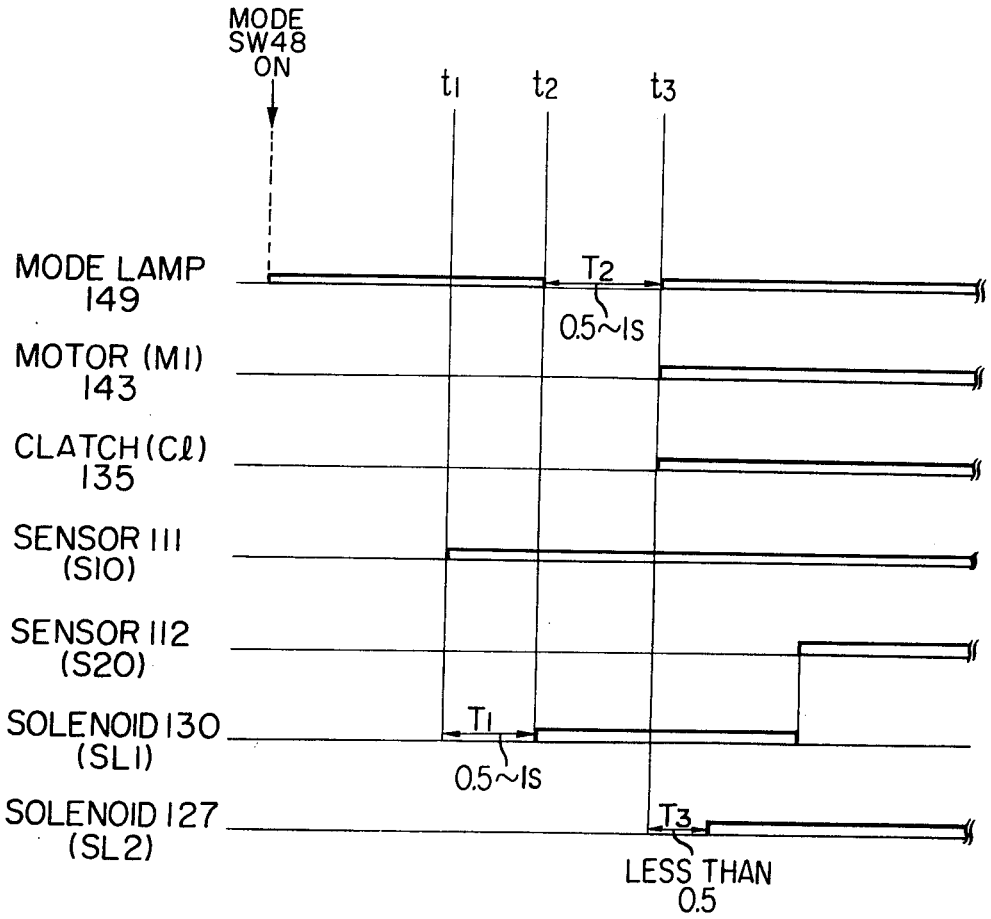
FIG. 18 is a signal timing chart of each portion of the FIG. 16 circuit.

Read-in of these input signals or ON-OFF of load is programmed by the ROM (read only memory) in the CPU 51 and control is effected in accordance with this program. FIG. 17 is a flow chart of this program in which the portions necessary to the present invention are taken out. FIG. 18 is a generation timing chart of input signals and control signals. Further description will be made by reference chiefly to FIG. 17.

At step 1 in FIG. 17, whether the mode switch 148 for changing over the mode to a sheet original automatic feeding mode is On is read-in from the input port and this is repeated until the mode switch 148 is ON. When the mode switch is ON, the program proceeds to step 2 and this step is repeated until the original is inserted. When the original is inserted, a first timer for counting a first predetermined time T1 is started. This timer is within the CPU 51 and it is a timer made in a soft fashion utilizing RAM (random access memory) and the steps of the program. By the first timer being time up, the program proceeds to step 3. At step 3, the original keep plunger 130 as the setting means for placing the pick-up roller at the feed starting position by signal SOL1 is energized, whereby the original may be properly held down even if the hand is released.

Accordingly, the original inserted within the first predetermined time T1 can be properly re-set to prevent its oblique movement or jam. This time T1 is usually set to 0.5–1 second, but a switch (not shown) or the like may be provided so that the time can be changed stepwise so as to accommodate to the ability of the operator.

Further, the mode lamp 149 is turned off as an indication which calls upon the operator to release bis hand from the original. At the same time, a timer T2 is started. At step 4, the presence of the original is detected by the sensor 111 (S10) while the mode lamp 149 is kept turned off until the second timer is time up. This means that the time is immediately before the original begins to be fed. The mode lamp 149 remains turned off because it is used also for this purpose, but alternatively another lamp may be provided near the original inlet port to provide a similar effect.

By the mode lamp being turned off for the second predetermined time, it can be suggested that if the original is moved during this time, it will be obliquely fed to make it impossible to obtain a proper image.

Watching the sensor 111 (S10) while counting the second predetermined time T2 is for the purpose of interrupting the automatic feeding of the original and eliminating a failure in the feeding of the original when the original has become absent for some reason or other.

At step 5, after the second timer has been time up, the mode lamp 149 is turned on to inform the operation of the feeding of the original and, after the count time T3 of a third timer during which the motor 143 and the clutch 135 are energized to transmit the drive to each portion, the original feeding plunger 127 (SL2) is energized to feed the original. When the original is fed, the sensor 112 (S20) detects the leading end of the original and the original keep solenoid SL1 is deenergized to make it possible to receive the next original, whereafter the clock pulse from the photointerrupter 139 is counted to control the original.

As described above, display means is provided which divides into two periods the time after an original has been inserted and before the feed roller is rotated and effects different displays during the preceding period and during the succeeding period. That is, the display means can separately display the condition in which replacement of the original is possible and the condition in which replacement of the original is impossible and can inform the operator of such conditions, thus preventing occurrence of inconveniences such as improper feeding or oblique feeding of the original. Moreover, such automatic original feeding device can be simply and inexpensively realized by adding a display device or by utilizing the lamp used.

What we claim is:

1. A paper leaf handling apparatus, comprising:
a paper leaf receiving unit having a plurality of trays;
moving means for moving said paper leaf receiving unit upwardly or downwardly, to position said plurality of trays in alignment with a paper leaf carry-out port so that paper leaves are received into said plurality of trays;
means for preventing said plurality of trays from falling;
means for releasing said preventing means; and
control means, responsive to the operation of said releasing means, for causing said moving means to initiate the downward movement of said paper leaf receiving unit.

2. A paper leaf handling apparatus according to claim 1, further comprising detecting means for detecting that said preventing means is released by said releasing means.

3. A paper leaf handling apparatus according to claim 1, wherein means are provided so that said paper leaf receiving unit is permitted to move upwardly even when said preventing means has been released.

4. A paper leaf handling apparatus, comprising:
a paper leaf receiving unit having a plurality of trays;
moving means for moving said paper leaf receiving unit upwardly or downwardly to position said plurality of trays in alignment with a paper leaf carry-out port so that paper leaves are received into said plurality of trays; and
control means for operatively controlling said moving means to select a non-sort tray from among said plurality of trays in response to a signal generated during the interruption of copying in a copying apparatus.

5. A paper leaf handling apparatus, comprising:
a paper leaf receiving unit having a plurality of trays;
moving means for moving said paper leaf receiving unit upwardly or downwardly to position said plurality of trays in alignment with a paper leaf carry-out port so that paper leaves are received into said plurality of trays; and
control means for operatively controlling said moving means to select a tray in response to a signal generated during an interruption of copying in a copying apparatus, wherein said tray is next to the tray into which a paper leaf is received immediately before commencement of the interruption of copying.

6. A paper leaf handling apparatus, comprising:

a paper leaf receiving unit having a plurality of trays;

moving means for moving said paper leaf receiving unit upwardly or downwardly to position said plurality of trays in alignment with a paper leaf carry-out port so that paper leaves are received into said plurality of trays; and control means for operatively controlling said moving means to select a particular tray from among said trays in response to a paper size signal.

7. A paper leaf handling apparatus, comprising:

a paper leaf receiving unit having a plurality of trays;

moving means for moving said paper leaf receiving unit upwardly or downwardly to position said plurality of trays in alignment with a paper leaf carry-out port so that paper leaves are received into said plurality of trays;

a moving member movable with said paper leaf receiving unit, and having thereon two different tray position display portions for displaying the tray positions;

two position detecting members for detecting said tray position display portions; and control means for operatively controlling said moving means by a combination of the output signals from said two position detecting members.

8. A paper leaf handling apparatus according to claim 7, wherein said tray position display portions are a display portion having a cut-away groove corresponding to each tray position, and a display portion having cut-away grooves corresponding to the uppermost and lowermost tray positions.

9. A paper leaf handling apparatus according to claim 8, wherein said position detecting members are photo-interrupters.

10. A paper leaf handling apparatus, comprising:

an original feeding tray for supporting thereon, one by one, sheet originals;

feed means for feeding a sheet original from said feeding tray to an exposure station;

detector means for detecting the presence of the sheet original on said feeding tray;

a first timer for counting a first predetermined period of time by the output from said detector means;

setting means for setting said feed means at a feed starting position upon termination of the period of time of said first timer;

a second timer for counting a second predetermined period of time; and drive means for driving said feed means upon termination of the period of time of said second timer.

11. A paper leaf handling apparatus according to claim 10, wherein said setting means is a normally raised pick-up roller which lowers after termination of the period of time of said first timer.

12. A paper leaf handling apparatus according to claim 10, wherein said detector means detects the absence of the sheet original during the period of time of said second timer, thereby rendering said drive means inoperative.

13. A paper leaf handling apparatus according to claim 10, further comprising display means effecting different displays during the period of time of said first timer and during the period of time of said second timer.

14. A paper leaf handling apparatus according to claim 13, wherein said display means is a display lamp adapted to be turned on to display that said paper leaf handling apparatus is selected.

15. A paper leaf handling apparatus according to claim 14, wherein said display lamp is turned off for a predetermined time after termination of the time count of said first timer.

16. A sheet original feeding device, comprising:

means for feeding an original to an exposure station;

first timer means for causing a feeding operation to be effected when the original has been positioned for a predetermined period of time, wherein said first timer starts the predetermined period of time when the original is detected as being positioned on said feeding means; and second timer means for positioning the original at said exposure station, and for feeding out from said exposure station the original which has been exposed.

17. A paper leaf handling apparatus, comprising:

a paper leaf receiving unit having a plurality of trays;

moving means for moving said paper leaf receiving unit upwardly or downwardly to position said plurality of trays in alignment with a paper leaf carry-out part so that paper leaves are received into said plurality trays;

mark members each provided on a respective tray;

sensing means for sensing said mark members; and control means for controlling the operation of said moving means in accordance with the output of said sensing means.

18. A paper leaf handling apparatus according to claim 17, wherein said mark members include a first mark member provided on the uppermost tray and a second mark member provided on the lowermost tray, and said control means controls the operation of said moving means in accordance with the output of said sensing means for sensing said mark members including said first and second mark members.

19. A paper leaf handling apparatus according to claim 18, wherein said sensing means has two sensing sections associated with said first and second mark members, respectively, and said control means controls the operation of said moving means in accordance with the combination of signals which are derived from said two sensing sections of said sensing means.

20. A paper leaf handling apparatus according to claim 17, 18 or 19, wherein said mark members have cut off slots corresponding to said plurality of trays.

21. A paper leaf handling apparatus according to claim 20, wherein said sensing sections include a photointerruptor.

* * * * *